US008163108B2

(12) United States Patent
Azuma et al.

(10) Patent No.: US 8,163,108 B2
(45) Date of Patent: Apr. 24, 2012

(54) HIGH-STRENGTH COLD-ROLLED STEEL SHEET, HIGH-STRENGTH GALVANIZED STEEL SHEET, AND HIGH-STRENGTH ALLOYED HOT-DIP GALVANIZED STEEL SHEET HAVING EXCELLENT FORMABILITY AND WELDABILITY, AND METHODS FOR MANUFACTURING THE SAME

(75) Inventors: Masafumi Azuma, Tokyo (JP); Naoki Yoshinaga, Tokyo (JP); Naoki Maruyama, Tokyo (JP); Noriyuki Suzuki, Tokyo (JP); Yasuharu Sakuma, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/736,154

(22) PCT Filed: Mar. 26, 2009

(86) PCT No.: PCT/JP2009/056148

§ 371 (c)(1),
(2), (4) Date: Sep. 13, 2010

(87) PCT Pub. No.: WO2009/119751

PCT Pub. Date: Oct. 1, 2009

(65) Prior Publication Data

US 2011/0008647 A1 Jan. 13, 2011

(30) Foreign Application Priority Data

Mar. 27, 2008 (JP) ..... 2008-083357

(51) Int. Cl.

| | |
|---|---|
| ***C22C 38/00*** | (2006.01) |
| ***C22C 38/18*** | (2006.01) |
| ***C22C 38/04*** | (2006.01) |
| ***C22C 38/14*** | (2006.01) |

(52) U.S. Cl. ..... 148/330; 148/328; 148/333; 420/104; 420/115; 420/120; 420/121; 420/126; 420/129

(58) Field of Classification Search ..... 148/538–664, 148/320–337; 420/8, 104–127, 129; *C21D 8/00, C21D 8/02, 8/04, 9/46, 9/48*

See application file for complete search history.

(56) References Cited

U.S. PATENT DOCUMENTS 4,466,842 A * 8/1984 Yada et al. ..... 148/564

FOREIGN PATENT DOCUMENTS

EP 1 900 838 3/2008

(Continued)

OTHER PUBLICATIONS

Computer-generated translation of JP 2007-302918, originally published in the Japanese language on Nov. 22, 2007.*

(Continued)

*Primary Examiner* — Scott Kastler
*Assistant Examiner* — Vanessa Luk
(74) *Attorney, Agent, or Firm* — Kenyon & Kenyon LLP

(57) ABSTRACT

This cold-rolled steel sheet includes, in terms of mass %, C: not less than 0.05% and not more than 0.095%, Cr: not less than 0.15% and not more than 2.0%, B: not less than 0.0003% and not more than 0.01%, Si: not less than 0.3% and not more than 2.0%, Mn: not less than 1.7% and not more than 2.6%, Ti: not less than 0.005% and not more than 0.14%, P: not more than 0.03%, S: not more than 0.01%, Al: not more than 0.1%, N: less than 0.005%, O: not less than 0.0005% and not more than 0.005%, and contains as the remainder, iron and unavoidable impurities, wherein the microstructure of the steel sheet includes mainly polygonal ferrite having a crystal grain size of not more than 4 μm, and hard microstructures of bainite and martensite, the block size of the martensite is not more than 0.9 μm, the Cr content within the martensite is 1.1 to 1.5 times the Cr content within the polygonal ferrite, and the tensile strength is at least 880 MPa.

6 Claims, 2 Drawing Sheets

FOREIGN PATENT DOCUMENTS

| | | | |
|---|---|---|---|
| JP | 57-137453 | | 8/1982 |
| JP | 59-219473 | | 12/1984 |
| JP | 63-293121 | | 11/1988 |
| JP | 11-279691 | | 10/1999 |
| JP | 2001-152287 | | 6/2001 |
| JP | 2001-220641 | | 8/2001 |
| JP | 2003-321733 | | 11/2003 |
| JP | 2004-256906 | | 9/2004 |
| JP | 2005-105367 | | 4/2005 |
| JP | 2005-213603 | | 8/2005 |
| JP | 2005-325393 | * | 11/2005 |
| JP | 2006-052455 | * | 2/2006 |
| JP | 2007-154305 | | 6/2007 |
| JP | 2007-177272 | | 7/2007 |
| JP | 2007-302918 | | 11/2007 |

OTHER PUBLICATIONS

Computer-generated translation of JP 2005-325393, published in the Japanese language on Nov. 24, 2005.*

Computer-generated translation of JP 2006-052455, published in the Japanese language on Feb. 23, 2006.*

International Search Report dated Jul. 14, 2009 issued in corresponding PCT Application No. PCT/JP2009/056148.

Takagi et al. "Material and Application Development of Body in White for Weight Reduction" Nissan Technical Review, No. 57 (Sep. 2005), pp. 4-7 [with English Abstract].

"High Strength Hot Rolled Sheet Steel with Good Stretch Flange Formability for Automotive Wheel" CAMP-ISIJ vol. 13 (2000) pp. 411-414 [with English Abstract].

"Effect of Microstructure on Formability and Derayed Cracking of Super High Strength Colled Rolled Steel Sheet" CAMP-ISIJ vol. 5 (1992) pp. 1839-1842 [with English Abstract].

"Effects of Microstructures on Stretch-Flangeability of Ultra High Strengthened Cold-rolled Steel Sheets" CAMP-ISIJ vol. 13 (2000) pp. 391-394 [with English Abstract].

* cited by examiner

HIGH-STRENGTH COLD-ROLLED STEEL SHEET, HIGH-STRENGTH GALVANIZED STEEL SHEET, AND HIGH-STRENGTH ALLOYED HOT-DIP GALVANIZED STEEL SHEET HAVING EXCELLENT FORMABILITY AND WELDABILITY, AND METHODS FOR MANUFACTURING THE SAME

TECHNICAL FIELD

The present invention relates to a high-strength cold-rolled steel sheet, a high-strength galvanized steel sheet and a high-strength alloyed hot-dip galvanized steel sheet having excellent formability and weldability, as well as methods for manufacturing these steel sheets.

This application is a national stage application of International Application No. PCT/JP2009/056148, filed Mar. 26, 2009, which claims priority to Japanese Patent Application No. 2008-083357, filed on Mar. 27, 2008, the content of which is incorporated herein by reference.

BACKGROUND ART

In recent years, in the automobile industry, high-strength steel sheet has been used to achieve a combination of functions for protecting the occupants in the case of a collision and a reduction in weight that improves fuel consumption. In terms of ensuring favorable safety during a collision, heightened appreciation of safety factors and more stringent regulations mean that there is now a need to use high-strength steel sheet for components of complex shape, which until now have been manufactured using low-EM strength steel sheet. For this reason, superior hole expansion properties are now being demanded for high-strength steel.

Many components within an automobile are joined using welding techniques such as spot welding, arc welding or laser welding, and therefore in order to enhance the collision safety for the vehicle, it is necessary that these joins do not fracture upon collision. In other words, if a fracture occurs at a joint upon collision, then even if the strength of the steel is adequate, the joint structure is unable to satisfactorily absorb the energy of the collision, making it impossible to achieve the required collision energy absorption performance.

Accordingly, automobile components must also exhibit excellent joint strength for joints manufactured by spot welding, arc welding, laser welding, or the like. However, a problem arises in that as the amounts of C, Si, Mn, and the like are increased to achieve greater strength for the steel sheet, an accompanying deterioration in the strength of the welded portions tends to occur, meaning it is desirable that strengthening of the steel is achieved without excessive increases in the amounts of the alloy elements incorporated within the steel.

Examples of indicators for evaluating the strength of a spot welded joint include a tensile shear strength (TSS) test prescribed in JIS Z 3136 in which a shear stress is applied to the weld, and a cross tension strength (CTS) test prescribed in JIS Z 3137 in which stress is applied in the direction of joint separation. Of these two tests, it is known that the TSS value increases with increasing steel sheet strength, whereas the CTS value does not increase even with an increase in the steel sheet strength. As a result, the ductility ratio, which is represented by the ratio between TSS and CTS, decreases with increased addition of alloy components to the steel, namely with increased steel strength. It is well known that high-strength steel sheet having a high C content has problems in terms of spot weldability (see Non-Patent Document 1).

On the other hand, formability of a material tends to deteriorate as the strength of the material is increased, and if a high-strength steel sheet is to be used for forming a member having a complex shape, then a steel sheet that satisfies both of favorable formability and high strength must be manufactured. Although the simple term "formability" is used, when applied to a member having a complex shape such as an automobile component, the component actually requires a combination of a variety of different formability properties including ductility, stretch formability, bendability, hole expandability, and stretch flange formability.

It is known that the ductility and the stretch formability correlate with the work hardening coefficient (the n value), and steel sheets having high n values are known to exhibit excellent formability. Examples of steel sheets that exhibit excellent ductility and stretch formability include DP (Dual Phase) steel sheets in which the microstructure of the steel sheet is composed of ferrite and martensite, and TRIP (Transformation Induced Plasticity) steel sheets in which the microstructure of the steel sheet includes residual austenite.

On the other hand, known examples of steel sheets that exhibit excellent hole expandability include steel sheets having a precipitation-strengthened ferrite single phase microstructure, and steel sheets having a bainite single phase microstructure (see Patent Documents 1 to 3, and Non-Patent Document 2).

Further, it is known that the bendability correlates with the structural uniformity, and it has been demonstrated that the bendability can be improved by improving the uniformity of the steel microstructure (see Non-Patent Document 3).

Accordingly, steel sheets in which the steel microstructure is formed as a precipitation-strengthened ferrite single phase microstructure (Non-Patent Document 2) and DP steel sheets which, although having dual phase microstructures composed of ferrite and martensite, exhibit enhanced uniformity as a result of miniaturization of the steel microstructures (see Patent Document 4) are already known.

DP steel sheets contain highly ductile ferrite as the main phase, and by dispersing martensite which is the hard microstructure within the microstructure of the steel sheet, excellent ductility can be achieved. Furthermore, the softer ferrite is easily molded, and because a large amount of dislocation is introduced at the same time as the molding, and is subsequently hardened, the n value is high. However, if the steel microstructure is composed of soft ferrite and hard martensite, then because the molding capabilities of the two microstructures differ, when molding is conducted as part of large scale operations such as hole expansion processing, minute microvoids tend to form at the interfaces between the two different microstructures, resulting in a marked deterioration in the hole expandability. The volume fraction of martensite incorporated within the DP steel sheet having a maximum tensile strength of 590 MPa or higher is comparatively large, and because the steel also contains a multitude of ferrite-martensite interfaces, the microvoids formed at these interfaces can readily interconnect, which can lead to cracking and fracture. For these reasons, the hole expandability properties of the DP steel sheets is poor (see Non-Patent Document 4).

It is known that a microstructure containing tempered martensite can be used to improve the hole expandability in these DP steel sheets composed of ferrite and martensite (see Patent Document 5). However, it is necessary to conduct an additional tempering treatment in order to improve the hole expandability; therefore, productivity problems arise. Moreover, a decrease in the strength of the steel sheet due to the tempered martensite is also unavoidable. As a result, the amount of C added to the steel must be increased to maintain the strength of the steel, but this causes a deterioration in the weldability. In other words, with regard to the DP steel sheets formed from ferrite and martensite, achieving both strength in the order of 880 MPa, as well as favorable hole expandability and weldability has proven impossible.

In addition, when tempered martensite is converted to a hard microstructure, the volume fraction of ferrite must be reduced in order to maintain the strength; however, this results in a deterioration in the ductility.

Furthermore, in a development related to the DP steel sheet, a high-tensile hot-dip galvanized steel sheet has been proposed that is composed of ferrite and a hard second phase, and this steel exhibits excellent balance between strength and ductility, as well as superior balance between bendability, spot weldability, and plating adhesion (see Patent Document 6). As the hard second phase, martensite, bainite, and residual austenite are exemplified. However, with regard to this high-tensile hot-dip galvanized steel sheet, annealing must be conducted at a high temperature within a range from A3 to 950° C.; therefore, there is a problem that the productivity is poor. In particular, if achieving favorable spot weldability is also taken into consideration, then the amount of C, which functions as an austenite stabilizing element (namely, an element that lowers the Ac3 point) added to the steel must be suppressed, which frequently results in high annealing temperatures and reduced productivity. Moreover, annealing at extremely high temperatures exceeding 900° C. is undesirable, because it can cause severe damage to the production equipments such as the furnace casing and the hearth roll, and it tends to promote the formation of surface defects on the surface of the steel sheet.

Further, with regard to the high-tensile hot-dip galvanized steel sheet proposed in Patent Document 6, the hole expandability is 55% at 918 MPa, 35% at 1035 MPa, 35% at 1123 MPa, and approximately 26% at 1253 MPa. In comparison, the hole expandability results for the present invention are 90% at 980 MPa, 50% at 1080 MPa, and 40% at 1180 MPa, indicating that with regard to the high-tensile hot-dip galvanized steel sheet of Patent Document 6, it impossible to achieve a satisfactory combination of strength and hole expandability.

The hole expandability ends to be similarly low in TRIP steel sheets in which the steel microstructure is composed of ferrite and residual austenite. This is because mold working of automobile components, including hole expanding and stretch flange forming, is conducted after punching out or mechanical cutting of the sheet.

The residual austenite contained within the TRIP steel sheets transforms into martensite when subjected to processing. For example, drawing or stretching of the steel causes the residual austenite to transform into martensite; thereby, increasing the strength of the processed portions, and by restricting the concentration of this transformation, a high degree of formability can be maintained.

However, when the steel is punched out or cut, the portions close to the edges are subjected to processing, and therefore the residual austenite incorporated within the steel microstructure in these portions transforms into martensite. As a result, a microstructure similar to that of a DP steel sheet is obtained, and the hole expandability and stretch flange formability tend to deteriorate. Alternatively, because the punching out process itself is a process that accompanies large deformation, it has been reported that after punching out of the steel, microvoids tend to exist at the interfaces between the ferrite and hard microstructures (in this case, the martensite formed by transformation of the residual austenite), resulting in a deterioration in the hole expandability. Moreover, steel sheets in which cementite or pearlite microstructures exist at the grain boundaries also exhibit poor hole expandability. This is because the interfaces between the ferrite and cementite act as origins for microscopic void formation.

Furthermore, in order to ensure that the residual austenite is maintained, a large amount of C must be concentrated within the austenite; however, compared with a DP steel having the same C content (a multi-phase steel sheet composed of ferrite and martensite), the volume fraction of hard microstructures tends to decrease, making it difficult to maintain strength. In other words, in the case in which a high strength of at least 880 MPa is ensured, the amount of added C required for strengthening increases considerably; thereby, causing a deterioration in the spot weldability. Accordingly, the upper limit for the volume fraction of residual austenite is 3%.

As a result, as disclosed in Patent Documents 1 to 3, research into steel sheets having excellent hole expandability has led to the development of high-strength hot-rolled steel sheets having single phase microstructure of either bainite or precipitation-strengthened ferrite as the main phase, in which a large amount of an alloy-carbide-forming element such as Ti is added to convert the C incorporated within the steel into an alloy carbide; thereby, suppressing the formation of a cementite phase at the grain boundaries, and yielding superior hole expandability.

In the case of a steel sheet having a bainite single phase microstructure, in order to convert the microstructure of the steel sheet to a bainite single phase microstructure, the production of the cold-rolled steel sheet must include first heating to a high temperature to form an austenite single phase; therefore, the productivity is poor. Furthermore, bainite microstructures include a large amount of dislocation; therefore, they exhibit poor workability and are difficult to use for components that require favorable ductility and stretch formability. Furthermore, if consideration is given to ensuring a high strength of at least 880 MPa, then an amount of C exceeding 0.1% by mass must be added, which means the steel suffers the aforementioned problem of being unable to achieve a combination of high strength and favorable spot weldability.

In steel sheets having a precipitation-strengthened ferrite single phase microstructure, precipitation strengthening provided by carbides of Ti, Nb, Mo, V, or the like is used to increase the strength of the steel sheet while suppressing the formation of cementite and the like; thereby, a steel sheet having a combination of a high strength of 880 MPa or higher and superior hole expandability can be obtained. However, in the case of cold-rolled steel sheets that undergo cold rolling and annealing steps, it is difficult to utilize the above precipitation strengthening effect.

In other words, the precipitation strengthening is accomplished by coherent precipitation of an alloy carbide of Nb or Ti or the like within the ferrite. In a cold-rolled steel sheet that has been subjected to cold rolling and annealing, because the ferrite is processed and is recrystallized during annealing, the orientation relationship with the coherent precipitated Nb or Ti precipitate during the hot rolling stage is lost; therefore, the strengthening function of the precipitate is largely lost, and making it difficult to use this technique for strengthening cold-rolled steel.

Further, it is known that when cold rolling is conducted, the Nb or Ti significantly delay the recrystallization, meaning that in order to ensure excellent ductility, a high-temperature annealing step is required, which results, in poor productivity.

Furthermore, even if ductility similar to that of hot-rolled steel sheet were to be obtained, precipitation-strengthened steel still exhibits inferior ductility and stretch formability; therefore, it is unsuitable for regions that require superior stretch formability.

Here, in the present invention, a steel sheet of which the product of the maximum tensile strength and the total elongation is 16,000 (MPa×%) or more is deemed to be high-strength steel having favorable ductility. In other words, the targeted ductility values are 18.2% at 880 MPa, 16.3% or greater at 980 MPa, 14.8% or greater at 1080 MPa, and 13.6% or greater at 1180 MPa.

Steel sheets that address these problems and are provided to satisfy a combination of superior ductility and hole expandability are disclosed in Patent Documents 7 and 8. These steel sheets are manufactured by initially forming a multi-phase microstructure composed of ferrite and martensite, and subsequently tempering and softening the martensite; thereby, an attempt is made to yield an improved balance between the strength and ductility, as well as a simultaneous improvement in the hole expandability, by structurally strengthening the steel.

However, even if improvements in the hole expandability and stretch flange formability are achieved by softening of hard microstructures due to tempering of the martensite, the problem of inferior spot weldability remains if applied to high-strength steel sheets of 880 MPa or higher.

For example, by tempering martensite, hard microstructures can be softened and the hole expandability can be improved. However, because a reduction in the strength also occurs simultaneously, the volume fraction of martensite must be increased so as to offset this reduction in strength; therefore, a large amount of C must be added. As a result, spot weldability and the like tend to deteriorate. Furthermore, in the case of using equipments such as hot-dip galvanizing equipment in which both of quenching and tempering cannot be conducted, a microstructure containing ferrite and martensite microstructure must first be formed, and a separate heat treatment must then be conducted; therefore, the productivity is poor.

On the other hand, it is well known that the strength of a welded joint is dependent on the amount of added elements, and particularly added C, contained within the steel sheet. It is known that by strengthening a steel sheet while restricting the amount of C added, a combination of favorable strength and favorable weldability (namely, maintenance of the joint strength of a welded portion) can be obtained. Because a welded portion is melted and then cooled at a rapid cooling rate, the microstructure of the hard portion becomes to mainly include martensite. Accordingly, the welded portion is extremely hard and exhibits poor deformability (molding capabilities). Moreover, even if the microstructure of the steel sheet has been controlled, because the steel is melted upon welding, control of the microstructure within the welded portion is extremely difficult. As a result, improvements in the properties of the welded portion have conventionally been made by controlling the components within the steel sheet (for example, see Patent Document 4 and Patent Document 9).

The description above also applies to steel sheets having a multi-phase microstructure containing ferrite and bainite. In other words, a bainite microstructure is formed at a higher temperature than a martensite microstructure, and is therefore considerably softer than martensite. As a result, bainite microstructures are known to exhibit superior hole expandability. However, since they are soft microstructures, it is difficult to achieve a high strength of 880 MPa or higher. In those cases where the main phase is ferrite and the hard microstructures are formed as bainite microstructures, in order to ensure a high strength of at least 880 MPa, the amount of added C must be increased, the proportion of bainite microstructures must be increased, and the strength of the bainite microstructures must be improved. This causes a marked deterioration in the spot weldability of the steel.

Patent Document 9 discloses that by adding Mo to a steel sheet, favorable spot weldability properties can be achieved even for steel sheets having a C content exceeding 0.1% by mass. However, although adding Mo to the steel sheet suppresses the formation of voids or cracks within the spot welded portion, and improves the strength of the welded joint for welding conditions where these types of defects occur readily, there is no improvement in the strength of the welded joint under conditions where the above defects do not occur. Furthermore, if consideration is given to achieving a high strength of at least 880 MPa, then addition of a large amount of C is unavoidable, and the problem remains that it is difficult to obtain a steel sheet that exhibits both favorable spot weldability and superior formability. Furthermore, because the steel sheet includes residual austenite as the hard microstructure, during hole expansion or stretch flange formation, stress tends to be concentrated at the interfaces between the soft ferrite that represents the main phase and the residual austenite that functions as the hard microstructure, resulting in microvoid formation and interconnection; thereby, deterioration occurs in these properties.

Furthermore, Mo tends to promote the formation of band-like microstructures, causing a deterioration in the hole expandability. Accordingly, in the present invention, as described below, investigations were focused on conditions that realized satisfactory weldability without the addition of Mo.

A known steel sheet that combines a high maximum tensile strength of at least 780 MPa with favorable spot weldability is disclosed in Patent Document 4 listed below. In this steel sheet, by utilizing a combination of precipitation strengthening due to the addition of Nb or Ti, fine-grain strengthening, and dislocation strengthening that utilizes non-recrystallized ferrite, a steel sheet that combines a strength of at least 780 MPa with superior ductility and bendability can be obtained even when the carbon content of the steel sheet is 0.1% by mass or less. However, in order to enable application to components having more complex shapes, further improvements in the ductility and hole expandability are still required. As described above, achieving a combination of high strength of at least 880 MPa and superior levels of ductility, stretch formability, bendability, hole expandability, stretch flange formability, and spot weldability has proven extremely difficult.

Patent Document 1: Japanese Unexamined Patent Application, First Publication No. 2003-321733

Patent Document 2: Japanese Unexamined Patent Application, First Publication No. 2004-256906

Patent Document 3: Japanese Unexamined Patent Application, First Publication No. H11-279691

Patent Document 4: Japanese Unexamined Patent Application, First Publication No. 2005-105367

Patent Document 5: Japanese Unexamined Patent Application, First Publication No. 2007-302918

Patent Document 6: Japanese Unexamined Patent Application, First Publication No. 2006-52455

Patent Document 7: Japanese Unexamined Patent Application, First Publication No. S63-293121

Patent Document 8: Japanese Unexamined Patent Application, First Publication No. S57-137453

Patent Document 9: Japanese Unexamined Patent Application, First Publication No. 2001-152287

Non-Patent Document 1: Nissan Technical Review, No. 57 (2005-9), p. 4

Non-Patent Document 2: CAMP-ISIJ vol. 13 (2000), p. 411

Non-Patent Document 3: CAMP-ISIJ vol. 5 (1992), p. 1839

Non-Patent Document 4: CAMP-ISIJ vol. 13 (2000), p. 391

DISCLOSURE OF INVENTION

Problems to be Solved by the Invention

The present invention takes the above circumstances into consideration, with an object of providing a steel sheet, a high-strength cold-rolled steel sheet and a high-strength galvanized steel sheet that have a maximum tensile strength of at least 880 MPa, and also exhibit superior levels of weldability, including spot weldability that is essential for manufacturing automobile components and the like, and formability such as ductility and hole expandability, as well as providing a production method that enables the above types of steel sheets to be manufactured cheaply.

Means to Solve the Problems

It is already well known that by using a DP steel sheet composed of ferrite and martensite, a high degree of strength and superior ductility can be achieved even if the amount of added elements is small. However, it is also known that DP steel sheets composed of ferrite and martensite also suffer from poor hole expandability. Furthermore, a known technique for increasing the strength and achieving a high strength exceeding 880 MPa involves increasing the volume fraction of martensite by adding a large amount of C, which acts as the source for the martensite. However, it is also known that increasing the amount of added C tends to cause an associated dramatic deterioration in the spot weldability. Accordingly, the inventors of the present invention focused their research on attempting to realize a DP steel sheet composed of ferrite and martensite that exhibited both high strength and superior spot weldability, properties which until now have been thought of as incompatible. In particular, the inventors attempted to manufacture a steel sheet having excellent hole expandability and high strength of welded portion as well as strength in the range of 880 MPa from a DP steel sheet composed of ferrite and martensite.

As a result of intensive investigation aimed at achieving the above object, the inventors of the present invention discovered that rather than increasing the volume fraction of the hard microstructures (martensite) contained with the steel sheet microstructure, by reducing the block size that represents a structural unit of the martensite, a maximum tensile strength of at least 880 MPa could be achieved even if the amount of added C was suppressed to 01. % or less. Furthermore, because this technique causes little increase in the volume fraction of martensite, the surface area ratio of soft microstructure (ferrite)/hard microstructure (martensite) interfaces, which act as sites for the formation of microvoids during hole expansion tests, can be reduced more than in conventional steels; thereby, the steel sheet also exhibits superior hole expandability. As a result, a steel sheet was able to be manufactured that exhibited a combination of a plurality of properties that have conventionally proven extremely difficult to achieve, namely a combination of superior weldability, hole expandability, and stretch formability.

In other words, the present invention provides a steel that has a maximum tensile strength of at least 880 MPa, and also exhibits excellent spot weldability, and formability such as ductility and hole expandability, as well as a method for manufacturing such a steel sheet. The main aspects of the present invention are as described below.

A high-strength cold-rolled steel sheet having excellent formability and weldability according to the present invention contains, in terms of mass %, C: not less than 0.05% and not more than 0.095%, Cr: not less than 0.15% and not more than 2.0%, B: not less than 0.0003% and not more than 0.01%, Si: not less than 0.3% and not more than 2.0%, Mn: not less than 1.7% and not more than 2.6%, Ti: not less than 0.005% and not more than 0.14%, P: not more than 0.03%, S: not more than 0.01%, Al: not more than 0.1%, N: less than 0.005%, and O: not less than 0.0005% and not more than 0.005%, and contains as the remainder, iron and unavoidable impurities, wherein the microstructure of the steel sheet includes mainly polygonal ferrite having a crystal grain size of not more than 4 μm, and hard microstructures of bainite and martensite, the block size of the martensite is not more than 0.9 μm, the Cr content within the martensite is 1.1 to 1.5 times the Cr content within the polygonal ferrite, and the tensile strength is at least 880 MPa.

The high-strength cold-rolled steel sheet having excellent formability and weldability according to the present invention may contain no Nb within the steel, and may have no band-like microstructures within the microstructure of the steel sheet.

The steel sheet may further include, in terms of mass %, one or more elements selected from the group consisting of Ni: less than 0.05%, Cu: less than 0.05%, and W: less than 0.05%.

The steel sheet may further include, in terms of mass %, V: not less than 0.01% and not more than 0.14%.

A high-strength galvanized steel sheet having excellent formability and weldability according to the present invention includes the high-strength cold-rolled steel sheet of the present invention described above, and a galvanized plating formed on the surface of the high-strength cold-rolled steel sheet.

A high-strength alloyed hot-dip galvanized steel sheet having excellent formability and weldability according to the present invention includes the high-strength cold-rolled steel sheet of the present invention described above, and an alloyed hot-dip galvanized plating formed on the surface of the high-strength cold-rolled steel sheet.

A method for manufacturing a high-strength cold-rolled steel sheet having excellent formability and weldability according to the present invention includes: heating a cast slab containing chemical components incorporated within the high-strength cold-rolled steel sheet of the present invention described above, either by heating the cast slab directly to a temperature of 1,200° C. or higher, or first cooling and subsequently heating the cast slab to a temperature of 1,200° C. or higher; subjecting the heated cast slab to hot rolling at a reduction ratio of at least 70% so as to obtain a rough rolled sheet; holding the rough rolled sheet for at least 6 seconds within a temperature range from 950 to 1,080° C., and then subjecting the rough rolled sheet to hot rolling under conditions where a reduction ratio is at least 85% and a finishing temperature is 820 to 950° C., so as to obtain a hot-rolled sheet; coiling the hot-rolled sheet within a temperature range from 630 to 400° C.; acid washing the hot-rolled sheet, and then subjecting the hot-rolled sheet to cold rolling at a reduction ratio of 40 to 70% so as to obtain a cold-rolled sheet; and feeding the cold-rolled sheet to a continuous annealing processing line, wherein the feeding of the cold-rolled sheet to the continuous annealing processing line comprises: raising a temperature of the cold-rolled sheet at a rate of temperature increase of not more than 7° C./second, holding a temperature of the cold-rolled sheet at a value of not less than 550° C. and not more than an Ac1 transformation point temperature for a period of 25 to 500 seconds, subsequently performing annealing at a temperature of 750 to 860° C., and then performing cooling to a temperature of 620° C. at a cooling rate of not more than 12° C./second, cooling from 620° C. to 570° C. at a cooling rate of at least 1° C./second, and then cooling from 250 to 100° C. at a cooling rate of at least 5° C./second.

A first aspect of a method for manufacturing a high-strength galvanized steel sheet having excellent formability and weldability according to the present invention includes: heating a cast slab containing chemical components incorporated within the high-strength cold-rolled steel sheet of the present invention described above, either by heating the cast slab directly to a temperature of 1,200° C. or higher, or by first cooling and subsequently heating the cast slab to a temperature of 1,200° C. or higher; subjecting the heated cast slab to hot rolling at a reduction ratio of at least 70% so as to obtain a rough rolled sheet; holding the rough rolled sheet for at least 6 seconds within a temperature range from 950 to 1,080° C., and then subjecting the rough rolled sheet to hot rolling under conditions where a reduction ratio is at least 85% and a finishing temperature is 820 to 950° C., so as to obtain a hot-rolled sheet; coiling the hot-rolled sheet within a temperature range from 630 to 400° C.; acid washing the hot-rolled sheet, and then subjecting the hot-rolled sheet to cold rolling at a reduction ratio of 40 to 70% so as to obtain a cold-rolled sheet; and feeding the cold-rolled sheet to a continuous hot-dip galvanizing processing line, wherein the feeding of the cold-rolled sheet to the continuous hot-dip galvanizing processing line comprises: raising a temperature of the cold-rolled sheet at a rate of temperature increase of not more than 7° C./second, holding a temperature of the cold-rolled sheet at a value of not less than 550° C. and not more than an Ac1 transformation point temperature for a period of 25 to 500 seconds, subsequently performing annealing at a temperature of 750 to 860° C., cooling from a maximum heating temperature during the annealing to a temperature of 620° C. at a cooling rate of not more than 12° C./second, cooling from 620° C. to 570° C. at a cooling rate of at least 1° C./second, dipping the cold-rolled sheet in a galvanizing bath, and then cooling from 250 to 100° C. at a cooling rate of at least 5° C./second.

A second aspect of a method for manufacturing a high-strength galvanized steel sheet having excellent formability and weldability according to the present invention includes: subjecting the cold-rolled steel sheet manufactured by the aforementioned method for manufacturing a high-strength cold-rolled steel sheet having excellent formability and weldability according to the present invention to zinc-based electroplating.

A method for manufacturing a high-strength alloyed hot-dip galvanized steel sheet having excellent formability and weldability according to the present invention includes: heating a cast slab containing chemical components incorporated within the high-strength cold-rolled steel sheet of the present invention described above, either by heating the cast slab directly to a temperature of 1,200° C. or higher, or by first cooling and subsequently heating the cast slab to a temperature of 1,200° C. or higher; subjecting the heated cast slab to hot rolling at a reduction ratio of at least 70% so as to obtain a rough rolled sheet; holding the rough rolled sheet for at least 6 seconds within a temperature range from 950 to 1,080° C., and then subjecting the rough rolled sheet to hot rolling under conditions where a reduction ratio is at least 85% and a finishing temperature is 820 to 950° C., so as to obtain a hot-rolled sheet; coiling the hot-rolled sheet within a temperature range from 630 to 400° C.; acid washing the hot-rolled sheet, and then subjecting the hot-rolled sheet to cold rolling at a reduction ratio of 40 to 70% so as to obtain a cold-rolled sheet; and feeding the cold-rolled sheet to a continuous hot-dip galvanizing processing line, wherein the feeding of the cold-rolled sheet to the continuous hot-dip galvanizing processing line comprises: raising a temperature of the cold-rolled sheet at a rate of temperature increase of not more than 7° C./second, holding a temperature of the cold-rolled sheet at a value of not less than 550° C. and not more than an Ac1 transformation point temperature for a period of 25 to 500 seconds, subsequently performing annealing at a temperature of 750 to 860° C., cooling from a maximum heating temperature during the annealing to a temperature of 620° C. at a cooling rate of not more than 12° C./second, cooling from 620° C. to 570° C. at a cooling rate of at least 1° C./second, dipping the cold-rolled sheet in a galvanizing bath, performing a galvannealing treatment at a temperature of at least 460° C., and then cooling from 250 to 100° C. at a cooling rate of at least 5° C./second.

Effect of the Invention

As described above, according to the present invention, by controlling the components of a steel sheet and the annealing conditions, a high-strength steel sheet having a maximum tensile strength of at least 880 MPa, and combining excellent spot weldability with superior formability such as ductility and hole expandability can be formed with good stability. The high-strength steel sheet of the present invention includes not only a typical cold-rolled steel sheet and galvanized steel sheet, but also steel sheets coated with various other plating such as an Al-plated steel sheet. The plating layer of the galvanized steel sheet may be either pure Zn, or may include other elements such as Fe, Al, Mg, Cr, or Mn.

BEST MODE FOR CARRYING OUT THE INVENTION

Figure 1:
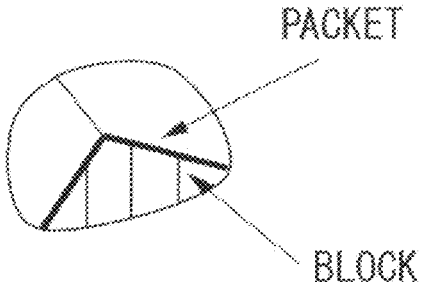
FIG. 1 is a schematic view illustrating one example of a martensite crystal grain within a steel sheet of the present invention.

A detailed description of embodiments of the present invention is presented below.

During their investigations, the inventors of the present invention first focused their attention on the following points.

In much of the research conducted until now, because it is extremely difficult to increase the hardness of martensite, increasing the hardness of steel has typically focused on increasing the volume fraction of martensite. As a result, the C content was increased considerably. Furthermore, because hard microstructures cause a deterioration in the hole expandability, investigations into hole expandability have focused on negating any adverse effects by eliminating hard microstructures, or improving upon these adverse effects by softening the hard microstructures. Accordingly, in conventional methods, because the C content is increased, inferior weldability has been unavoidable. Because the problems described above derive from the difficulty associated with increasing the hardness of martensite, the inventors of the present invention focused their research on techniques for increasing the hardness of martensite.

First, an investigation was conducted of the factors controlling the strength of the martensite microstructure. It is already well known that the hardness (strength) of martensite microstructures is dependent on the solid-solubilized C content within the martensite, the crystal grain size, precipitation strengthening due to carbides, and dislocation strengthening. In addition, recent research has revealed that the hardness of a martensite microstructure is dependent on the crystal grain size, and particularly on the block size that is one example of structural units constituting the martensite. Accordingly, rather than increasing the volume fraction of martensite, the inventors developed the concept of hardening the martensite by reducing the block size; thereby, ensuring favorable hardness.

Furthermore, in terms of hole expandability, the inventors of the present invention conceived a novel technique in which rather than softening the hard microstructures that cause deterioration in the hole expandability, a completely opposite approach to conventional techniques was adopted in that the strength of the hard microstructures was further enhanced; thereby, enabling the volume fraction to be reduced, which caused a reduction in the number of crack-forming sites upon hole expansion testing and enabled an improvement in hole expandability, and the inventors then conducted intensive research into this novel technique. First, as a result of their intensive research, the inventors of the present invention discovered that crack propagation during hole expansion molding of a steel sheet including soft microstructures and hard microstructures is caused by the formation of microscopic defects (microvoids) at the interfaces between the soft microstructures and the hard microstructures, and the interconnection of these microvoids. Accordingly, the inventors conceived that in addition to the conventional technique of suppressing microvoid formation at the interfaces by reducing the difference in hardness between the soft microstructures and the hard microstructures, a new technique could also be used in which the interconnection of the microvoids could be inhibited by reducing the volume fraction of hard microstructures.

As a result, the inventors discovered that by restricting the martensite block size to not more than 0.9 μm, a significant increase in the strength (hardness) of the hard microstructures could be achieved, while at the same time, deterioration in other properties resulting from improvement in the hole expandability could be ameliorated, including any decrease in strength due to softening of the hard microstructures, deterioration in the spot weldability due to the increase in C content caused by the increase in the volume fraction of the hard microstructures required in order to achieve satisfactory hardening with softer hard microstructures, and deterioration in the ductility due to an increase in the hard microstructure fraction.

Furthermore, because satisfactory strength can be achieved even with a relatively small volume fraction of the hard microstructures, the volume fraction of ferrite can be increased. This means that a high degree of ductility can also be obtained.

At the same time, increasing the strength by reducing the grain size of the ferrite can be used in combination with the above technique, and the inventors discovered that even if the volume fraction of the hard microstructures was suppressed, namely even if the amount of added C was restricted to not more than 0.1%, a maximum tensile strength of at least 880 MPa was still achievable, and the weldability was also excellent.

First is a description of the reasons for restricting the steel microstructure.

In the present invention, one of the most important features is the reduction of the martensite block size to not more than 0.9 μm.

The inventors of the present invention first investigated various techniques for increasing the strength of martensite. It is already well known that the hardness (strength) of martensite microstructures is dependent on the content of solid-solubilized C within the martensite, the crystal grain size, precipitation strengthening due to carbides, and dislocation strengthening. In addition, recent research has revealed that the hardness of a martensite microstructure is dependent on the crystal grain size, and particularly on the block size that is one example of structural units constituting the martensite.

For example, as illustrated in the schematic representation of FIG. 1, martensite has a hierarchical structure composed of a number of structural units. The martensite microstructure includes groups of very fine laths having the same orientation (variant), which are known as blocks, and packets which are composed of a number of these blocks. One packet is composed of a maximum of 6 blocks having a specific orientation relationship (K-S/Kurdjumov-Sachs relationship). Generally, observation under an optical microscope is unable to distinguish blocks having variants with minimal difference in the crystal orientation; therefore, a pair of blocks having variants with minimal difference in the crystal orientation may sometimes be defined as a single block. In such cases, one packet is composed of three blocks. However, the block size of a martensite block having identical crystal orientation is very large, and is typically within a range from several μm to several tens of μm. As a result, in a thin steel sheet in which the steel sheet microstructure has been controlled to manufacture a fine grain microstructure of not more than several μm, the size of the individual martensite grains that function as the strengthening microstructures is also not more than several μm, and the individual martensite grains are each composed of a single block. Accordingly, it was discovered that in conventional steels, fine grain strengthening in martensite is not being satisfactorily utilized. In other words, the inventors discovered that by further reducing the size of the martensite blocks that exist within the steel sheet, the strength of the martensite could be further enhanced, and a high strength exceeding 980 MPa could be achieved even if the amount of added C within the steel sheet was suppressed to less than 0.1%.

Figure 3:
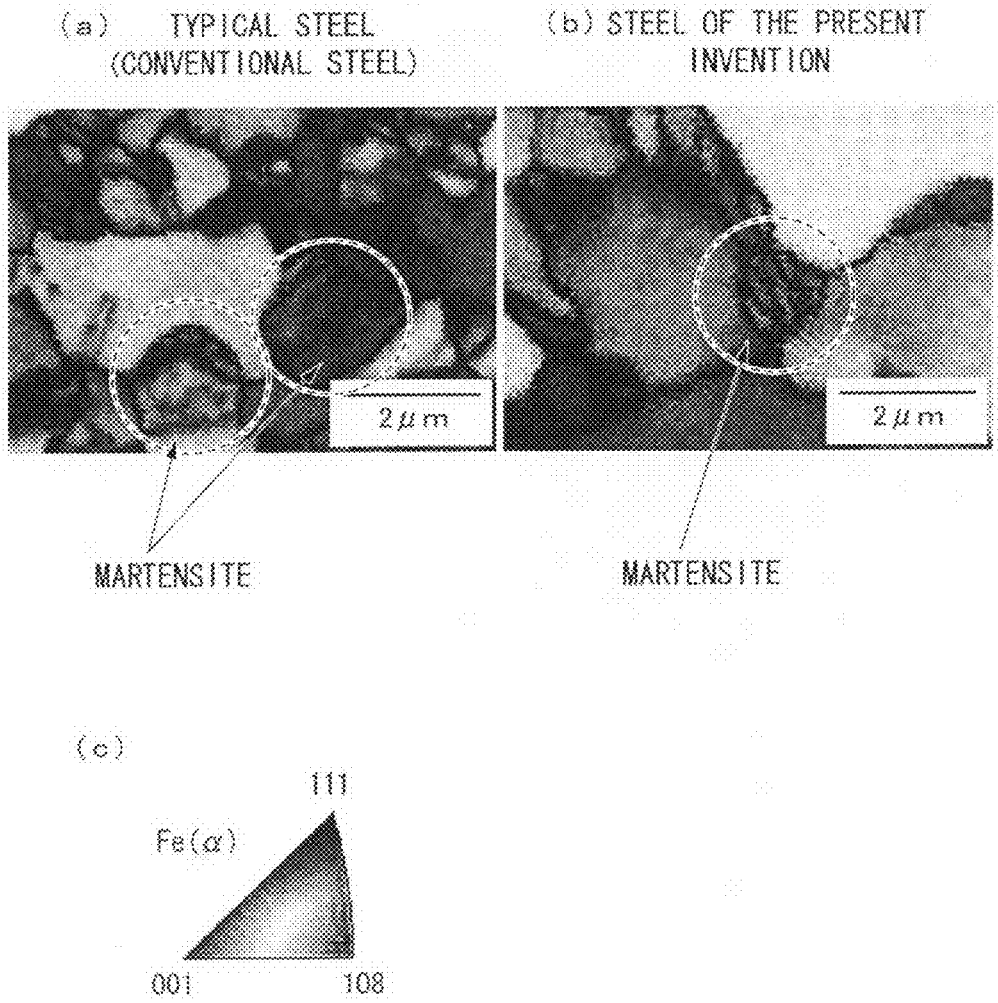
FIG. 3(*a*) is an SEM EBSP image of the microstructure of a conventional steel, FIG. 3(*b*) is an SEM EBSP image of the microstructure of a steel according to the present invention, and FIG. 3(*c*) is a diagram illustrating the relationship between the color (grayscale) and the crystal orientation for each of the microstructures shown in the SEM EBSP images.

FIG. 3 shows SEM EBSP images of the microstructures of a typical steel (conventional steel) and a steel of the present invention. In high-strength steel sheets exceeding 880 MPa, because the microstructure of the steel sheet is comparatively small, and satisfactory resolution can not be attained using an optical microscope, measurements were conducted using a SEM EBSP method. As explained in FIG. 3(*c*), the color (grayscale) of each microstructure corresponds with the crystal orientation for that microstructure. Furthermore, grain boundaries at which the difference in orientation is 15° or greater are shown as black lines. As is evident from FIG. 3(*a*), the martensite microstructures within a typical steel (conventional steel) are often composed of a single block, and the block size is large. In contrast, as can be seen in FIG. 3(*b*), in the steel of the present invention, the block size is small, and the martensite microstructure is composed of a plurality of blocks.

By reducing the martensite block size in this manner, a high strength exceeding 980 MPa can be achieved even if the amount of added C is reduced to less than 0.1%. As a result, the volume fraction of the martensite can be suppressed to a low level, and the number of ferrite-martensite interfaces that act as microvoid formation sites during hole expansion testing can be reduced, which is effective in improving the hole expandability. Alternatively, because a predetermined strength can be ensured without increasing the amount of added C, the amount of C added to the steel can be reduced; thereby, enabling an improvement in the spot weldability.

In this description, the martensite block size describes the length (width) across the direction perpendicular to the lengthwise direction (longer direction) of the block. The reason for restricting the martensite block size to not more than 0.9 μm is that the most marked increases in the martensite strength were observed when the size was reduced to not more than 0.9 μm. Accordingly, this block size is preferably not more than 0.9 μm. If the block size exceeds 0.9 μm, then the strengthening effect resulting from the increase in the hardness of the martensite microstructures becomes difficult to obtain; therefore, the amount of added C must be increased, which leads to undesirable deterioration in the spot weldability and hole expandability properties. The block size is preferably 0.7 μm or smaller, and more preferably 0.5 μm or smaller.

Forming the ferrite that represents the main phase of the steel sheet microstructure as a polygonal ferrite, and restricting the crystal grain size of that polygonal ferrite to a value of not more than 4 μm are also important features. The importance of these features lies in the fact that by strengthening the ferrite, the volume fraction of the martensite required for ensuring the desired strength can be reduced, the amount of added C can be reduced, and the proportion of ferrite-martensite interfaces that act as microvoid formation sites during hole expansion testing can also be reduced. The reason for restricting the crystal grain size of the polygonal ferrite of the main phase to not more than 4 μm is that such sizes enable the amount of added C to be suppressed to not more than 0.095% by mass, while still achieving a maximum tensile strength of at least 880 MPa and favorable properties of hole expandability and weldability. These effects are most marked when the ferrite crystal grain size is restricted to not more than 4 μm, and therefore the crystal grain size limit is set to not more than 4 μm. A crystal grain size of 3 μm or less is even more desirable.

On the other hand, ultra fine grains in which the crystal grain size is less than 0.6 μm are also undesirable, as they are not only economically unviable, but are also prone to reductions in the uniform elongation and n value, and tend to suffer from inferior stretch formability and ductility. For these reasons, the crystal grain size is preferably at least 0.6 μm.

In the present invention, the term "polygonal ferrite" refers to ferrite grains of which the crystal grain aspect ratio (=ferrite crystal grain size in the rolling direction/ferrite crystal grain size in the sheet thickness direction) is not more than 2.5. Observation of the steel microstructure is conducted from a direction perpendicular to the rolling direction, and if the aspect ratio of at least 70% of the total volume of main phase ferrite grains is not more than 2.5, then the main phase is deemed to be composed of a polygonal ferrite. On the other hand, ferrite of which the aspect ratio exceeds 2.5 is referred to as "elongated ferrite."

The reason for specifying that the steel sheet microstructure includes mainly polygonal ferrite is that such a microstructure ensures a favorable level of ductility. Because the steel sheet of the present invention is manufactured by cold rolling a hot-rolled sheet and then performing annealing, if the level of recrystallization during the annealing step is inadequate, then in the cold-rolled state, ferrite which is elongated in the rolling direction will remain. This elongated ferrite microstructures often include a large amount of dislocation, and therefore exhibits poor formability and inferior ductility. Accordingly, the main phase of the steel sheet microstructure must be composed of a polygonal ferrite. Furthermore, even for a ferrite that has undergone satisfactory recrystallization, if elongated ferrite microstructures are oriented along the same direction, then during tensile deformation or hole expansion deformation, localized deformation may occur at portions within the crystal grains or at the interfaces that contact with the hard microstructures. As a result, microvoid formation and interconnection are promoted, which tend to cause deterioration in the bendability, hole expandability, and stretch flange formability. For these reasons, a polygonal ferrite is preferred as the ferrite.

Here, ferrite refers to either recrystallized ferrite that is formed during annealing, or transformed ferrite that is generated during the cooling process. In the cold-rolled steel sheet of the present invention, because the steel sheet components and the production conditions are strictly controlled, the growth of recrystallized ferrite is suppressed by the addition of Ti to the steel, whereas the growth of transformed ferrite is suppressed by the addition of Cr or Mn to the steel. In either case, the ferrite grain size is small, with the crystal grain size not exceeding 4 μm, and therefore the ferrite may include either recrystallized ferrite or transformed ferrite. Furthermore, even in the case of ferrite microstructures that include a large amount of dislocations, in the cold-rolled steel sheet of the present invention, because strict control of the steel sheet components, the hot rolling conditions, and the annealing conditions enables the ferrite microstructures to be kept small and degradation in the ductility to be prevented, the steel may also include such ferrite microstructures containing dislocations, if the volume fraction is less than 30%.

In the present invention, the ferrite preferably includes no bainitic ferrite. Bainitic ferrite includes a large amount of dislocations, and therefore tends to cause a deterioration in the ductility. Accordingly, the ferrite is preferably a polygonal ferrite.

The reason for specifying martensite as the hard microstructures is to enable a maximum tensile strength of at least 880 MPa to be achieved while suppressing the amount of added C. Generally, bainite and tempered martensite are softer than freshly generated martensite that has not been tempered. As a result, if bainite or tempered martensite is used for the hard microstructures, then the strength of the steel decreases significantly; therefore, the volume fraction of hard microstructures must be increased by increasing the amount of added C, in order to ensure the desired level of strength. This results in an undesirable deterioration in the weldability. However, if martensite having a block size of not more than 0.9 μm is included as the hard microstructure, the steel may also include bainite microstructures at the volume fraction of less than 20%. Furthermore, the steel may also include cementite or pearlite microstructures within the amounts that cause no reduction in the strength of the steel.

Furthermore, if consideration is given to ensuring a maximum tensile strength of at least 880 MPa, then it is essential to include the hard microstructures described above, and the C content of the steel sheet must be restricted to a level that causes no deterioration in the weldability, namely an amount not exceeding 0.095%, while the steel must also include the above hard microstructures.

The martensite preferably has a polygonal configuration. Martensite that is elongated in the rolling direction or exists while having needle like shape tends to cause heterogeneous stress accumulation and deformation, promotes the formation of microvoids, and can be linked to a deterioration in the hole expandability. For these reasons, the configuration for the colony of hard microstructure is preferably a polygonal configuration.

In the steel sheet microstructure, the main phase must be a ferrite. This is because by using a highly ductile ferrite as the main phase, a combination of superior ductility and hole expandability can be achieved. If the volume fraction of ferrite falls below 50%, then the ductility tends to decrease significantly. For this reason, the ferrite volume fraction must be at least 50%. On the other hand, if the volume fraction of ferrite exceeds 90%, then ensuring a maximum tensile strength of at least 880 MPa becomes difficult, and therefore the upper limit for the ferrite volume fraction is set to 90%. In order to achieve a particularly superior balance of ductility and hole expandability, the volume fraction is preferably within a range from 55 to 85%, and even more preferably from 60 to 80%.

On the other hand, for the same reasons as those described above, the volume fraction of hard microstructures must be restricted to less than 50%. This volume fraction of hard microstructures is preferably within a range from 15 to 45%, and more preferably from 20 to 40%.

Furthermore, the interior of the martensite preferably contains no cementite. Cementite precipitation inside the martensite causes a reduction in the solid-solubilized C within the martensite, which results in a reduction in strength. For this reason, the interior of the martensite preferably contains no cementite.

On the other hand, residual austenite may be included between laths of martensite, in adjacent contact with the martensite microstructure, or within the ferrite microstructures. This is because residual austenite is transformed into martensite when subjected to deformation, and therefore contributes to strengthening of the steel.

However, because residual austenite incorporates a large amount of C, the existence of excess residual austenite can cause a reduction in the volume fraction of the martensite. For this reason, the upper limit for the volume fraction of residual austenite is preferably 3%.

In the present invention, a mixed microstructure of ferrite and undissolved cementite obtained when annealing is performed in a temperature range lower than the Ac1 value is classified as a ferrite single phase microstructure. The reason for this classification is that because the steel sheet microstructure contains no pearlite, bainite, or martensite, no structural strengthening can be obtained from these microstructures, and the microstructure is therefore classified as a ferrite single phase microstructure. Accordingly, this microstructure does not represent a microstructure of the cold-rolled steel sheet according to the present invention.

For each phase of the above microstructure, the identification of ferrite, pearlite, cementite, martensite, bainite, austenite, and other residual microstructures, the observation of the positioning of those microstructures, and measurements of surface area ratios can be conducted using any one of an optical microscope, a scanning electron microscope (SEM), or a transmission electron microscope (TEM). In this type of research, a cross-section along the rolling direction of the steel sheet or a cross-section in a direction orthogonal to the rolling direction can be etched using either a nital reagent or a reagent disclosed in Japanese Unexamined Patent Application, First Publication No. S59-219473, and then quantified by inspection at 1,000-fold magnification under an optical microscope, or inspection at 1,000 to 100,000-fold magnification using a scanning or transmission electron microscope. In the present invention, observation was conducted at 2,000-fold magnification using a scanning electron microscope, 20 fields of view were measured, and the point count method was used to determine the volume fractions.

In terms of measurement of the martensite block size, the microstructure was observed using an FE-SEM EBSP method and the crystal orientations were determined; thereby, the block size was measured. In the steel sheet of the present invention, because the martensite block size is considerably smaller than that of conventional steels, care must be taken to ensure that the step size is set to be adequate small value during the FE-SEM EBSP analysis. In the present invention, scanning was typically conducted at a step size of 50 nm, the microstructure of each martensite grain microstructure was analyzed, and the block size was determined.

The reason for specifying the Cr content within the martensite as 1.1 to 1.5 times the Cr content within the polygonal ferrite is that when Cr is concentrated within the martensite or the austenite that exists prior to its transformation into martensite, a higher level of strength can be ensured by reducing the size of the martensite blocks, and the strength of welded joints can be increased by suppressing any softening of the steel during welding. During the hot rolling step or the heating conducted after the annealing following cold rolling, the Cr concentrated within the cementite prevents coarsening of the cementite; thereby, enabling the martensite block size to be reduced, and this contributes to improved strength. During annealing, the cementite is transformed into austenite, and therefore the Cr incorporated within the cementite is inherited by the austenite. Moreover, this austenite is then transformed into martensite during the cooling conducted after the annealing step. Accordingly, the Cr content within the martensite must be set to 1.1 to 1.5 times the Cr content within the polygonal ferrite.

Furthermore, the Cr concentrated within the martensite suppresses softening of welded portions and increases the strength of welded joints. Typically, when spot welding, arc welding, or laser welding is conducted, the welded portions are heated and the melted portions are then cooled rapidly; therefore, martensite becomes the main microstructure within the joint. However, the surrounding regions (the heat-affected portions) are heated to a high temperature and undergo a tempering treatment. As a result, the martensite is tempered and significantly softened. On the other hand, if a large amount of an element that forms alloy carbides such as Cr alloy carbide ($Cr_{23}C_6$) is added, then these carbides precipitate during the heat treatment; thereby, enabling a suppression of any softening. By concentrating Cr within the martensite in the manner described above, the softening of welded portions can be suppressed, and the strength of welded joints can be further improved. However, if the Cr is incorporated uniformly throughout the steel, then the precipitation of the alloy carbides takes considerable time, or there is a reduction in the effect of suppressing the softening, and therefore in the present invention, in order to further enhance the effect of suppressing the softening of the welded portions, the Cr concentration treatment is conducted into specific locations during the hot rolling and annealing heating stages; thereby, enhancing the improvement in welded joint strength achieved as a result of suppressing the softening, even in the case of a short heat treatment such as welding.

The Cr content within the martensite and polygonal ferrite can be measured by EPMA or CMA at 1,000 to 10,000-fold magnification. Because the crystal grain size of the martensite incorporated within the steel of the present invention is not more than 4 μm and therefore relatively small, the beam spot diameter must be reduced as much as possible when measuring the Cr concentration within the crystal grains. In the research conducted for the present invention, analysis was conducted by EPMA, at 3,000-fold magnification and using a spot diameter of 0.1 μm.

In the present invention, the hardness ratio between the martensite and the ferrite (namely, hardness of martensite/hardness of polygonal ferrite) is preferably 3 or greater. The reason for this preference is that by dramatically increasing the hardness of the martensite compared with the ferrite, a maximum tensile strength of at least 880 MPa can be achieved with a small amount of the martensite. As a result, improvements can be achieved in the weldability and hole expandability of the steel.

In contrast, in a steel sheet containing martensite microstructures with larger block sizes, the hardness ratio between the martensite and the ferrite is approximately 2.5, which is comparatively small compared with the steel of the present invention having smaller martensite blocks. As a result, in typical steels, the volume fraction of martensite is increased and the hole expandability deteriorates. Alternatively, the amount of added C may be increased to increase the volume fraction of martensite, but this results in inferior weldability.

The hardness of the martensite and ferrite may be measured by a penetration depth measuring method using a dynamic hardness meter, or by an indentation size measuring method that combines a nanoindenter and a SEM.

In the research of the present invention, a penetration depth measuring method that used a dynamic microhardness meter having a Berkovich type triangular pyramidal indenter was used to measure the hardness values. In preliminary testing, hardness measurements were conducted using a variety of different loadings, the relationship between the hardness, indentation size, tensile properties, and hole expandability was ascertained, and measurements were then conducted at a penetration loading of 0.2 gf. The reason for using a penetration depth measuring method is because the size of the martensite microstructures that exist within the steel of the present invention is not more than 3 μm, which represents an extremely small value, and if the hardness is measured using a more typical Vickers tester, then the indentation size would be larger than the martensite size; therefore, it is extremely difficult to measure the hardness of solely the fine martensite microstructures. Alternatively, the indentation size would be so small that it would be difficult to accurately measure the size under a microscope. In the present invention, 1,000 indentations were made, a hardness distribution was determined, a Fourier transform was then conducted to calculate the average hardness of each individual microstructure, and the ratio between the hardness corresponding with the ferrite (DHTF) and the hardness corresponding with the martensite (DHTM), namely the ratio DHTM/DHTF was calculated.

Because the bainite microstructures incorporated within the steel microstructure are softer than the martensite microstructures, it is difficult to use these bainite microstructures as the main factor in determining the maximum tensile strength and hole expandability. Accordingly, in the present invention, only the difference in hardness between the softest ferrite and the hardest martensite was evaluated. Regardless of the hardness of the bainite microstructures, if the hardness ratio of the martensite relative to the ferrite falls within the specified range, the superior hole expandability and formability that represents effects of the present invention can be achieved.

In the cold-rolled steel sheet of the present invention, the tensile strength (TS) is at least 880 MPa. If the strength is less than this value, then the strength can be ensured even when the amount of added C within the steel sheet is restricted to not more than 0.1% by mass, and deterioration in the spot weldability can be prevented. However, when each of the elements is incorporated in the amount specified by the conditions of the present invention, and the microstructure of the steel satisfies the conditions prescribed in the present invention, a steel sheet can be obtained that has a tensile strength (TS) of at least 880 MPa, and also exhibits a superior balance between the ductility, stretch formability, hole expandability, bendability, stretch flange formability, and weldability.

A description of the reasons for restricting the amounts of the components within the steel sheet of the present invention is presented below.

In the following description, unless stated otherwise, the % values of each component represent "% by mass" values.

The steel sheet microstructure of the present invention can only be manufactured by performing a combined addition of C, Cr, Si, Mn, Ti, and B, and controlling the hot rolling and annealing conditions within prescribed ranges. Furthermore, because the roles of each of these elements differ, all of these elements must be added in combination.

(C: not Less than 0.05% and not More than 0.095%)

C is an essential element for structural strengthening using martensite.

If the amount of C is less than 0.05%, then it becomes difficult to achieve the volume fraction of the martensite necessary to ensure a tensile strength of at least 880 MPa, and therefore the lower limit of C is set to 0.05%. In contrast, the reason for restricting the C content to not more than 0.095% is because if the amount of C exceeds 0.095%, then the deterioration in the ductility ratio, which is represented by the ratio between the joint strength in a tensile shear strength test and the joint strength in a cross tension strength test, tends to deteriorate markedly. For these reasons, the C content must be within a range from 0.05 to 0.095%.

(Cr: not Less than 0.15% and not More than 2.0%)

Cr is not only a strengthening element, but also significantly reduces the martensite block size within the microstructure of the cold-rolled sheet that represents the final product by controlling the microstructure within the hot-rolled sheet. Therefore, Cr is an extremely important element in the present invention. Specifically, in the hot-rolling stage, Cr carbides are precipitated with TiC and TiN acting as nuclei. Subsequently, even if cementite is precipitated, the Cr is concentrated within the cementite during the annealing conducted after cold rolling. These carbides that contain Cr are thermally more stable than typical iron-based carbides (cementite). As a result, coarsening of the carbides during the heating conducted during the subsequent cold rolling-annealing process can be suppressed. This means that, compared with a typical steel, a multitude of very fine carbides exist within the steel at temperatures just below the Ac1 transformation point during annealing. When the steel sheet containing these very fine carbides is heated at a temperature of not less than the Ac1 transformation point, the carbides begin to transform into austenite. The finer the carbides are, the smaller the austenite microstructures will be, and because austenite microstructures formed with the fine carbides as nuclei mutually collide, aggregated austenite is formed from a plurality of these carbide nuclei. This aggregated austenite may appear as a single austenite microstructure, but because it is composed of individual austenite microstructures having different orientations, the martensite microstructures formed within the austenite will also have different orientations. Furthermore, because austenite microstructures are positioned adjacently, when a martensite transformation occurs within an austenite microstructure, the adjacent austenite also undergoes a deformation. The dislocation introduced during this deformation induces the formation of a martensite having a different orientation; therefore, resulting in a further reduction in bock size.

On the other hand, in a conventional steel sheet, even if the cementite that exists within the hot-rolled sheet were to be dispersed finely, when the subsequent cold-rolling and annealing process is conducted, the cementite becomes considerably coarser during the heating conducted during annealing. As a result, the austenite formed by transformation of the cementite also becomes coarser. Moreover, coarse austenite often exists either within a ferrite grain, or in an isolated position at a grain boundary (the proportion of cases where the austenite shares a grain boundary with another austenite is small); therefore, there is little chance that a martensite lath having a different orientation may be formed as a result of interaction with a martensite lath that has undergone transformation within another austenite microstructure. Accordingly, the martensite microstructures cannot be reduced in size, and in some cases, martensite microstructures composed of a single block may be formed.

For the reasons described above, Cr must be added to the steel.

On the other hand, although Nb and Ti carbides exhibit excellent thermal stability, because they do not melt during either a continuous annealing process or the annealing conducted during continuous hot-dip galvanizing, they are unlikely to contribute to a reduction in the size of the austenite microstructures.

Furthermore, the addition of Cr also contributes to a reduction in the size of the ferrite microstructures. In other words, during annealing, a new ferrite (recrystallized ferrite) is formed from the cold-rolled state ferrite, and recrystallization proceeds via the growth of this new ferrite. However, because austenite within the steel prevents the growth of ferrite, finely dispersed austenite causes pinning of the ferrite, and contributes to a reduction in the ferrite size. For this reason, Cr addition also contributes to increases in the yield stress and the maximum tensile strength.

However, because even these precipitates melt and are transformed into austenite at temperatures of not less than the maximum temperature Ac1 reached during either continuous annealing or the annealing conducted during continuous hot-dip galvanizing, in a cold-rolled steel sheet, a galvanized steel sheet, or an alloyed hot-dip galvanized steel sheet, although an increase in the Cr concentration within the austenite can be observed, in many cases cementite containing a high concentration of Cr carbides or Cr cannot be observed.

The aforementioned effects achieved by adding Cr are particularly marked when the amount of added Cr is at least 0.15%, and therefore the lower limit for the Cr content is set to 0.15%. On the other hand, compared with Fe, Cr is a relatively easily oxidized element, and therefore addition of a large amount of Cr tends to cause formation of oxides at the surface of the steel sheet, which tends to inhibit the plating properties or chemical conversion coatability, and may cause formation of a large amount of oxides at the welded portions during flash butt welding, arc welding, or laser welding that leads to a deterioration in the strength of the welded portions. These problems become significant if the amount of added Cr exceeds 2.0%, and therefore the upper limit for the Cr content is set to 2.0%. The Cr content is preferably within a range from 0.2 to 1.6%; and is more preferably from 0.3 to 1.2%.

(Si: not Less than 0.3% and not More than 2.0%)

Si is a strengthening element, and because it is not solid-solubilized in cementite, Si has the effect of suppressing formation of cementite nuclei. In other words, because Si suppresses cementite precipitation within the martensite microstructures, it contributes to strengthening of the martensite. If the amount of added Si is less than 0.3%, then either no increase in strength can be expected due to solid solution strengthening, or cementite formation within the martensite cannot be inhibited, and therefore at least 0.3% of Si must be added. On the other hand, if the amount of added Si exceeds 2.0%, then the amount of residual austenite tends to increase excessively; thereby, causing a deterioration in the hole expandability and stretch flange formability after punching out or cutting of the steel. For this reason, the upper limit for the Si content must be set to 2.0%.

Moreover, Si is easily oxidized, and in a typical thin steel sheet production processing line such as a continuous annealing processing line or a continuous hot-dip galvanizing processing line, even an atmosphere that functions as a reducing atmosphere for Fe can often act as an oxidizing atmosphere for Si; therefore, the Si readily forms oxides on the surface of the steel sheet. Furthermore, because Si oxides exhibit poor wettability with hot-dip galvanizing, they can cause plating faults. Accordingly, in hot-dip galvanized steel sheet production, the oxygen potential within the furnace is preferably controlled to inhibit the formation of Si oxides on the steel sheet surface.

(Mn: not Less than 1.7% and not More than 2.6%)

Mn is a solid solution strengthening element, and also suppresses the transformation of austenite into pearlite. For these reasons, Mn is an extremely important element. In addition, Mn also contributes to suppression of ferrite growth after annealing, and is therefore also important in terms of its contribution to reduction of the ferrite size.

If the Mn content is less than 1.7%, then the pearlite transformation can not be suppressed; thereby, it becomes difficult to ensure a volume fraction of at least 10% of martensite, and a tensile strength of at least 880 MPa cannot be ensured. For these reasons, the lower limit for the Mn content is at least 1.7%. In contrast, if a large amount of Mn is added, then co-segregation with P and S is promoted, which causes a marked deterioration in the workability. This problem becomes significant if the amount of added Mn exceeds 2.6%, and therefore the upper limit for the Mn Content is set to 2.6%.

(B: not Less than 0.0003% and not More than 0.01%)

B suppresses ferrite transformation after annealing and is therefore a particularly important element. Furthermore, B also inhibits the formation of coarse ferrite in the cooling step after finish rolling in the hot rolling step, and promotes uniform fine dispersion of iron-based carbides (cementite and pearlite microstructures). If the amount of added B is less than 0.0003%, then these iron-based carbides cannot be dispersed uniformly and finely. As a result, even if Cr is added, coarsening of the cementite cannot be satisfactorily suppressed, resulting in an undesirable reduction in the strength and a deterioration in the hole expandability. For these reasons, the amount of added B must be at least 0.0003%. On the other hand, if the amount of added B exceeds 0.010%, then not only does the effect of the B become saturated, but the production properties during hot rolling tend to deteriorate, and therefore the upper limit for the B content is set to 0.010%.

(Ti: not Less than 0.005% and not More than 0.14%)

Ti contributes to a reduction in the ferrite size by delaying recrystallization, and must therefore be added.

Furthermore, by adding Ti in combination with B, the Ti promotes the ferrite transformation delaying effect provided by B after annealing, and the resulting reduction in the ferrite size; therefore, Ti is an extremely important element. Specifically, it is known that the ferrite transformation delaying effect provided by B is caused by solid-solubilized B. Accordingly, it is important that during the hot rolling stage, the B is not precipitated as B nitride (BN). As a result, it is necessary to suppress the formation of BN by adding Ti, which is a stronger nitride-forming element than B. Accordingly, adding Ti and B in combination promotes the ferrite transformation delaying effect provided by B. Furthermore, Ti is also important in terms of its contribution to improving the strength of the steel sheet due to precipitation strengthening and fine grain strengthening that is achieved by suppressing the growth of ferrite crystal grains. These effects are not achievable if the amount of added Ti is less than 0.005%, and therefore the lower limit for the Ti content is set to 0.005%. On the other hand, if the amount of added Ti exceeds 0.14%, then the ferrite recrystallization is excessively delayed; thereby, non-recrystallized ferrite that is elongated in the rolling direction may remain, causing a dramatic deterioration in the hole expandability. For this reason, the upper limit for the Ti content is 0.14%.

(P: not More than 0.03%)

P tends to be segregated within the central portion through the thickness of the steel sheet, and causes embrittlement of the welded portions. If the amount of P exceeds 0.03%, then this weld embrittlement becomes marked, and therefore the allowable range for the P content is restricted to not more than 0.03%.

There are no particular restrictions on the lower limit for P, although reducing the P content to less than 0.001% is unviable economically, and therefore this value is preferably set as the lower limit.

(S: not More than 0.01%)

If the amount of S exceeds 0.01%, then the S has an adverse effect on the weldability and the production properties during casting and hot rolling, and therefore the allowable range for the S content is restricted to not more than 0.01%. There are no particular restrictions on the lower limit for S, although reducing the S content to less than 0.0001% is unviable economically, and therefore this value is preferably set as the lower limit. Furthermore, because S binds with Mn to form coarse MnS, it tends to cause a deterioration in the hole expandability. Accordingly, in terms of hole expandability, the S content should be suppressed to as low a level as possible.

(Al: not More than 0.10%)

Al promotes the formation of ferrite, which improves the ductility, and may therefore be added if desired. Furthermore, Al can also act as a deoxidizing material. However, excessive addition increases the number of Al-based coarse inclusions, which can cause a deterioration in hole expandability as well as surface defects. These problems become particularly marked if the amount of added Al exceeds 0.1%, and therefore the upper limit for the Al content is set to 0.1%. Although there are no particular restrictions on the lower limit for Al, reducing the Al content to less than 0.0005% is problematic, and this value therefore becomes the effective lower limit.

(N: Less than 0.005%)

N forms coarse nitrides and causes deterioration in both of the bendability and the hole expandability, and the amount of added N must therefore be suppressed. Specifically, if the N content is 0.005% or greater, then the above tendencies become significant, and therefore the allowable range for the N content is set to less than 0.005%. Moreover, N can also cause blow holes during welding, and therefore the N content is preferably as low as possible. Furthermore, if the N content is much larger than the amount of added Ti, then BN is formed and the effects achieved by adding B are diminished; therefore, the N content is preferably kept as low as possible. Although there are no particular restrictions on the lower limit for the N content in terms of the achieving the effects of the present invention, reducing the N content to less than 0.0005% tends to cause a significant increase in production costs, and this value therefore becomes the effective lower limit.

(O: not Less than 0.0005% and not More than 0.005%)

O forms oxides that cause a deterioration in the bendability and hole expandability, and the amount of added O must therefore be restricted. In particular, O often exists in the form of inclusions, and if these exist at a punched out edge or a cut cross-section, then notch-like surface defects or coarse dimples may form at the edge surface. As a result, stress concentration tends to occur during hole expansion or large deformation process, which can then act as an origin for crack formation; therefore, a dramatic deterioration in the hole expandability and bendability occurs. Specifically, if the O content exceeds 0.005%, then these tendencies become particularly marked, and therefore the upper limit for the O content is set to 0.005%. On the other hand, reducing the O content to less than 0.0005% is excessively expensive and therefore undesirable economically. Accordingly the lower limit for the O content is set to 0.0005%. However, the effects of the present invention are still obtained even if the O content is reduced to less than 0.0005%.

The cold-rolled steel sheet of the present invention contains the above elements as essential components, while containing as the remainder, iron and unavoidable impurities.

The cold-rolled steel sheet of the present invention preferably contains no added Nb or Mo. Since Nb and Mo dramatically delay the recrystallization of ferrite, non-recrystallized ferrite tends to remain within the steel sheet. The non-recrystallized ferrite is a processed microstructure that exhibits poor ductility, and is undesirable because it tends to cause a deterioration in the ductility of the steel. Furthermore, non-recrystallized ferrite is ferrite that has been formed during hot rolling and then elongated during cold rolling, and therefore has a shape that is elongated in the rolling direction. Furthermore, if the recrystallization delay becomes too great, then the volume fraction of non-recrystallized ferrite microstructures that have been stretched in the rolling direction tends to increase, and band-like microstructures composed of linked non-recrystallization ferrite grains may even occur.

Figure 2:
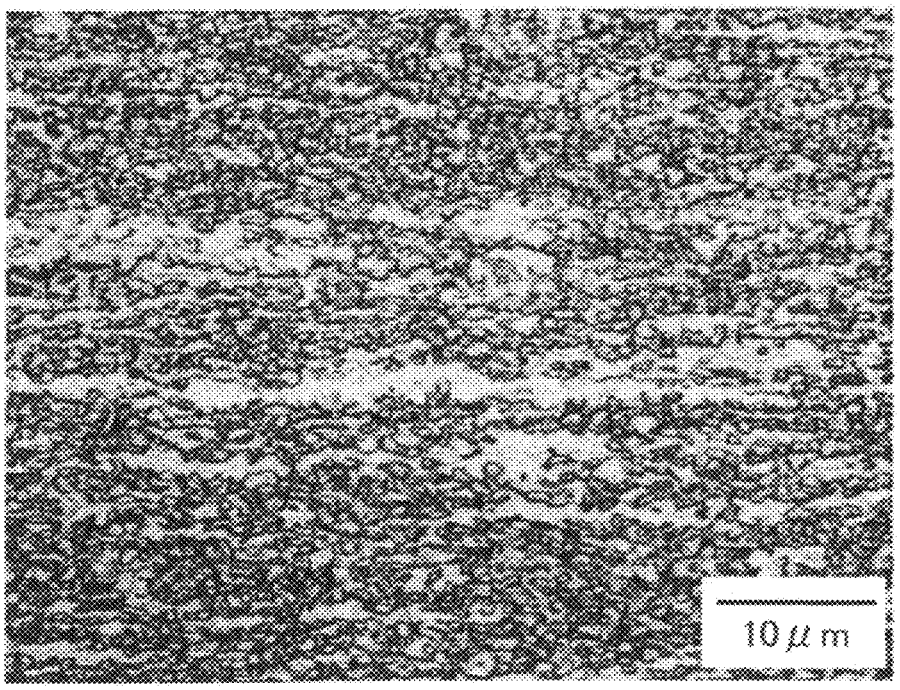
FIG. 2 is an optical microscope photograph showing band-like microstructures.

FIG. 2 is an optical microscope photograph of a steel sheet having band-like microstructures. Because the steel sheet has layer-like microstructures that extend in the rolling direction, in tests such as hole expansion processing that are likely to cause cracking and to develop the cracking, cracks tend to develop along the these layer-like microstructures. As a result, the properties of the steel deteriorate. In other words, these types of uneven microstructures that extend in a single direction tend to suffer from stress concentration at the interfaces of the microstructures, and are undesirable as they tend to promote crack propagation during hole expansion testing. For these reasons, Nb and Mo are preferably not added to the steel sheet.

In a similar manner to Ti, V contributes to a reduction in size of the ferrite microstructures, and may therefore be added to the steel. Compared with Nb, V has a smaller recrystallization delaying effect and is therefore less likely to make non-recrystallized ferrite remain. This means V is able to suppress deterioration in hole expandability and ductility to a minimum, while achieving increased strength.

(V: not Less than 0.01% and not More than 0.14%)

V contributes to improved strength and hole expandability for the steel sheet due to precipitation strengthening and fine grain strengthening that is achieved by suppressing the growth of ferrite crystal grains, and is therefore an important element. These effects are not achievable if the amount of added V is less than 0.01%, and therefore the lower limit for the V content is set to 0.01%. On the other hand, if the amount of added V exceeds 0.14%, then nitride precipitation increases and the formability tends to deteriorate, and therefore the upper limit for the V content is 0.14%.

Ni, Cu, and W, in a similar manner to Mn, delay the ferrite transformation in the cooling step conducted after annealing, and one or more of these elements may therefore be added to the steel. As described below, the preferred amounts for Ni, Cu, and W are each less than 0.05%, and the total amount of Ni, Cu, and W is preferably less than 0.3%. These elements tend to be concentrated at the surface; thereby, causing surface defects, and may also inhibit the concentration of Cr within the austenite, and the amounts added are therefore preferably suppressed to minimal levels.

(Ni: Less than 0.05%)

Ni is a strengthening element, and also delays the ferrite transformation in the cooling step conducted after annealing, and contributes to a reduction in the ferrite grain size, and may therefore be added to the steel. If the amount of added Ni is 0.05% or greater, then there is a danger that the concentration of Cr within the austenite may be inhibited, and therefore the upper limit for the Ni content is set to less than 0.05%.

(Cu: Less than 0.05%)

Cu is a strengthening element, and also delays the ferrite transformation in the cooling step conducted after annealing, and contributes to a reduction in the ferrite grain size, and may therefore be added to the steel. If the amount of added Cu is 0.05% or greater, then there is a danger that the concentration of Cr within the austenite may be inhibited, and therefore the upper limit for the Cu content is set to less than 0.05%. Furthermore, Cu may also cause surface defects, and therefore the upper limit for the Cu content is preferably less than 0.05%.

(W: Less than 0.05%)

W is a strengthening element, and also delays the ferrite transformation in the cooling step conducted after annealing, and contributes to a reduction in the ferrite grain size, and may therefore be added to the steel. Furthermore, W also delays the ferrite recrystallization, and therefore also contributes to fine grain strengthening and an improvement in hole expandability by reducing the size of the ferrite grains. However, if the amount of added W is 0.05% or greater, then there is a danger that the concentration of Cr within the austenite may be inhibited, and therefore the upper limit for the W content is set to less than 0.05%.

Next is a description of the reasons for restricting the production conditions for the steel sheet of the present invention.

As described above, the properties of the steel sheet of the present invention can be accomplished by satisfying the feature of containing ferrite which has a crystal grain size of not more than 4 μm as the main phase, the feature in which martensite in hard microstructures has a block size of not more than 0.9 μm, and the feature in which the Cr content within the martensite is 1.1 to 1.5 times the Cr content within the polygonal ferrite. In order to obtain such a steel sheet microstructure, the conditions during the hot rolling, the cold rolling, and the annealing must be strictly controlled.

Specifically, by first conducting hot rolling, microstructures other than ferrite such as cementite and Cr alloy carbide ($Cr_{23}C_6$) are finely precipitated. This cementite is formed at low temperatures, but has a property of promoting the concentration of Cr. Then, during the temperature raising that occurs during the annealing step after hot rolling, the cementite is decomposed to generate austenite. At this time, the Cr within the cementite is concentrated within the austenite. In this manner, Cr is concentrated within the austenite. Because the austenite is transformed into martensite, the method described above can be used to manufacture a cold-rolled steel sheet having martensite that contains concentrated Cr.

Ti precipitates are closely related to the generation of cementite and Cr alloy carbides during the hot rolling step, and it is important to include such Ti precipitates within the steel. After the rough rolling, the rough-rolled sheet is held for at least 6 seconds at a temperature within a range from 950 to 1,080° C.; thereby, forming Ti precipitates and facilitating the precipitation of fine cementite.

Furthermore, in the annealing step, by gradually heating the cold-rolled sheet at a rate of temperature increase of not more than 7° C./second, a greater amount of cementite can be precipitated.

The above method can be used to precipitate fine cementite particles other than the ferrite grains.

Generally, the diffusion of Cr within ferrite and austenite is fairly slow, and requires a considerably long time, and it has therefore been thought that concentrating Cr within austenite is difficult to achieve. However, by using the method described above, Cr can be concentrated within the austenite; thereby, a cold-rolled steel sheet is manufactured which has martensite that contains concentrated Cr.

A more detailed description of each of the steps is provided below.

There are no particular restrictions on the slab supplied to the hot rolling step, if the slab contains the aforementioned chemical components for the cold-rolled steel sheet of the present invention. In other words, the slab may be manufactured using a continuous slab casting device, a thin slab caster, or the like. Furthermore, a process such as a continuous casting-direct rolling (CC-DR) process in which the slab is subjected to hot rolling immediately after casting may be employed.

First, the slab is heated, either by heating the slab directly to a temperature of 1,200° C. or higher, or by first cooling and subsequently heating the slab to a temperature of 1,200° C. or higher.

The heating temperature for the slab must be sufficient to ensure that coarse Ti carbonitrides precipitated during the casting can be remelted, and must therefore be at least 1,200° C. There are no particular restrictions on the upper limit for the slab heating temperature, and the effects of the present invention can be obtained at higher temperatures; however, if the heating temperature is raised excessively, then the heating becomes economically undesirable, and the upper limit for the heating temperature is therefore preferably set to less than 1,300° C.

Next, the heated slab is subjected to hot rolling (rough rolling) under conditions that yield a total reduction ratio of at least 70%; thus, forming a rough rolled sheet. This rough rolled sheet is then held for at least 6 seconds at a temperature within a range from 950 to 1,080° C. As a result of this (hot rolling) reduction ratio of at least 70% and the subsequent retention within a temperature range from 950 to 1,080° C., carbonitrides such as TiC, TiCN, and TiCS are precipitated finely; thereby, enabling the austenite grain size after finish rolling to be kept uniformly small. Calculation of the reduction ratio is performed by dividing the sheet thickness after rolling by the sheet thickness prior to rolling and multiplying by 100.

The reason for specifying a reduction ratio of at least 70% is that this enables the introduction of a large amount of dislocations; thereby, increasing the number of Ti carbonitride precipitation sites and promoting such precipitation. If the reduction ratio is less than 70%, then a significant precipitate promoting effect cannot be obtained, and a uniform fine austenite grain size cannot be achieved. As a result, the ferrite grain size after cold rolling and annealing cannot be reduced, and the hole expandability tends to deteriorate; therefore, it is undesirable. Although there are no particular restrictions on the upper limit for the reduction ratio, raising this ratio beyond 90% is problematic in terms of productivity and equipment constraints, and therefore, 90% becomes the effective upper limit.

The holding temperature after rolling must be not less than 950° C. and not more than 1,080° C. As a result of intensive investigation, the inventors of the present invention discovered that this holding temperature is closely related to the precipitate behavior of Ti carbonitride prior to finish rolling and to the hole expandability. In other words, precipitation of these carbonitride compounds occurs fastest in the vicinity of 1,000° C., and as the temperature moves further from this value, precipitation in the austenite region tends to slow. In other words, at a temperature exceeding 1,080° C., considerable time is required for formation of the carbonitride compounds, and therefore reduction in the austenite grain size does not occur. As a result, no improvement in hole expandability can be achieved; therefore, it is not preferable. At temperatures less than 950° C., considerable time is required for precipitation of the carbonitride compounds, and therefore it is impossible to reduce the grain size of recrystallized austenite, making it difficult to achieve an improvement in the hole expandability. For these reasons, the holding temperature prior to finish rolling is preferably conducted within a range from 950 to 1,080° C.

A steel sheet such as the cold-rolled steel sheet of the present invention, which has a strength of at least 880 MPa after cold rolling and annealing, contains large amounts of Ti and B, and also contains large amounts of added Si, Mn, and C, and as a result, the finish rolling force during hot rolling increases; thereby, increasing the loading in the rolling process. Conventionally, the rolling force has often been reduced by either increasing the temperature at the finish rolling supply side, or conducting rolling (hot rolling) with a lower reduction ratio. As a result, the production conditions during hot rolling are outside those specified for the present invention, and achieving the desired effects from Ti addition has proven difficult. Increasing the finish rolling temperature or lowering the reduction ratio in this manner causes non-uniformity within the hot-rolled sheet microstructures obtained by transforming from austenite. This causes a deterioration in the hole expandability and the bendability, and is therefore undesirable.

Subsequently, the rough rolled sheet is subjected to hot rolling (finish rolling) under conditions including a total reduction ratio of at least 85% and a finish temperature within a range from 820 to 950° C. These reduction ratio and temperature are determined from the viewpoints of achieving superior size reduction and uniformity for the steel microstructures. In other words, if rolling is conducted with a reduction ratio of less than 85%, then it is difficult to achieve a satisfactory reduction in the size of the microstructures. Further, if rolling is conducted with a reduction ratio exceeding 98%, then excessive additions are required to the production equipment, and therefore the upper limit for the reduction ratio is preferably 98%. A more preferred reduction ratio is within a range from 90 to 94%.

If the finishing temperature is less than 820° C., then the rolling can be considered partially ferrite range rolling, which makes it difficult to control the sheet thickness and tends to have an adverse effect on the quality of the product, and therefore 820° C. is set as the lower limit. In contrast, if the finishing temperature exceeds 950° C., then it is difficult to achieve a satisfactory reduction in the size of the microstructures, and therefore 950° C. is set as the upper limit. A more preferably range for the finishing temperature is within a range from 860 to 920° C.

After finish rolling, the steel sheet is subjected to water cooling or air cooling, and must be coiled within a temperature range from 400 to 630° C. This ensures that a hot-rolled steel sheet is obtained in which iron-based carbides are dispersed uniformly through the steel microstructure, resulting in improvements in the hole expandability and bendability after cold rolling and annealing. During this cooling process, or after the coiling process, $Cr_{23}C_6$ and cementite are precipitated with the Ti precipitates acting as nuclei. If the coiling temperature exceeds 630° C., then the steel sheet microstructures tend to become ferrite and pearlite microstructures, the carbides cannot be dispersed uniformly, and the microstructure after annealing tends to lack uniformity, which is undesirable. In contrast, if the coiling temperature is less than 400° C., then precipitation of $Cr_{23}C_6$ becomes problematic, Cr cannot be concentrated within the austenite, and it becomes impossible to achieve the combination of high strength with superior weldability and hole expandability that represents the effects of the present invention. Furthermore, the strength of the hot-rolled sheet becomes excessively high, making cold rolling difficult, and this is also undesirable.

During hot rolling, rough rolled sheets may be joined together, so that the finish rolling may be conducted continuously. Furthermore, the rough rolled sheet may also be coiled prior to subsequent processing.

The hot-rolled steel sheet manufactured in the manner described above is then subjected to acid washing. The acid washing enables the removal of oxides from the surface of the steel sheet, and is therefore important in terms of improving the chemical conversion properties of the high-strength cold-rolled steel sheet that represents the final product, or improving the molten plating properties of the cold-rolled steel sheet used for manufacturing a hot-dip galvanized steel sheet or an alloyed hot-dip galvanized steel sheet. Furthermore, either a single acid washing may be conducted, or the acid washing may be performed across several repetitions.

The acid-washed hot-rolled steel sheet is then subjected to cold rolling with a reduction ratio of 40 to 70%, thus forming a cold-rolled sheet. This cold-rolled sheet is then fed to a continuous annealing processing line or a continuous hot-dip galvanizing processing line. If the reduction ratio is less than 40%, then it becomes difficult to retain a flat shape. Moreover, the ductility of the final product also tends to deteriorate, and therefore the lower limit is set to 40%. In contrast, if the reduction ratio exceeds 70%, then the cold rolling force becomes too large, making cold rolling difficult, and therefore the upper limit is set to 70%. A more preferred range is from 45 to 65%. There are no particular restrictions on the number of rolling passes or the reduction ratio for each pass, which have little impact on the effects of the present invention.

Subsequently, the cold-rolled sheet is fed to a continuous annealing apparatus. First, in a temperature range of less than 550° C., the temperature of the cold-rolled sheet is raised at a heating rate (a rate of temperature increase) of not more than 7° C./second. During this process, further cementite particles are precipitated at the dislocations introduced during cooling, and further Cr concentration within the cementite occurs. Accordingly, concentration of Cr within the austenite can be promoted, and also, the combination of high strength with superior spot weldability and hole expandability that represents the effect of the present invention can be achieved. If the heating rate exceeds 7° C./second, then this type of promotion of cementite precipitation and further Cr concentration within the cementite is impossible; therefore, the effects of the present invention cannot be realized. Furthermore, if the heating rate is less than 0.1° C./second, then the productivity decreases markedly, which is undesirable.

The cold-rolled sheet is then held at a temperature of not less than 550° C. and not more than the Ac1 transformation point temperature for a period of 25 to 500 seconds. This causes further precipitation of cementite with the $Cr_{23}C_6$ precipitated grains acting as nuclei. Furthermore, Cr can be concentrated within the precipitated cementite. Concentration of the Cr within the cementite is promoted by the dislocations generated during cold rolling. If the holding temperature is higher than the Ac1 transformation point temperature, then recovery (elimination) of the dislocations generated during the cold rolling becomes significant; thereby, concentration of the Cr is slowed. Furthermore, cementite precipitation does not occur, and therefore the cold-rolled sheet must be held at a temperature of not less than 550° C. and not more than the Ac1 transformation point temperature for a period of 25 to 500 seconds. If the holding temperature is less than 550° C., then the Cr diffusion is slow, and considerable time is required for the concentration of Cr within the cementite; therefore, it becomes difficult to realize the effects of the present invention. For this reason, the holding temperature is specified as not less than 550° C. and not more than the Ac1 transformation point temperature. Moreover, if the holding time is shorter than 25 seconds, then the concentration of Cr within the cementite tends to be inadequate. If the holding time is longer than 500 seconds, then the steel becomes overly stabilized, and melting during annealing requires a very long time, causing a deterioration in the productivity. Moreover, the term "holding" refers not only to simply maintaining the same temperature for a predetermined period, but also a residence period within the above temperature range during which gradual heating or the like may occur.

Here, the Ac1 transformation point temperature refers to the temperature calculated using the formula shown below.

$$Ac1=723-10.7\times\%\ Mn-16.9\times\%\ Ni+29.1\times\%\ Si+16.9\times\%\ Cr$$

(wherein % Mn, % Ni, % Si, and % Cr refer to the amounts (% by mass) of the various elements Mn, Ni, Si, and Cr respectively within the steel)

Next, the cold-rolled sheet is annealed at a temperature of 750 to 860° C. By setting the annealing temperature to a high temperature that exceeds the Ac1 transformation point, a transformation from cementite to austenite is achieved, and the Cr is retained in a concentrated state within the austenite.

During this annealing step, austenite is generated with the finely precipitated cementite grains acting as nuclei. This austenite is transformed into martensite in a later step, and therefore in a steel such as the steel of the present invention where fine cementite is dispersed through the steel at high density, the martensite microstructures will also be reduced in size. In contrast, in a conventional steel, the cementite becomes coarser during heating, and therefore the austenite generated by reverse transformation from the cementite also becomes coarser. On the other hand, if this coarsening is suppressed, then it is thought that because the austenite grains generated from each of the cementite microstructures exist in close proximity, they may appear as a single lump, but because their properties are different (namely, their orientations are different), the block size can actually be reduced. As a result, the hardness of the martensite can be adjusted to a very high level, and a strength of at least 880 MPa can be achieved even if the amount of added C is suppressed to not more than 0.1%. This enables a combination of high strength and superior weldability and hole expandability to be achieved.

Furthermore, because no Nb is added to the steel of the present invention, recrystallization of ferrite is facilitated, enabling the formation of polygonal ferrite. In other words, non-recrystallized ferrite and band-like microstructures that are elongated in the rolling direction do not exist. As a result, no deterioration in hole expandability occurs.

In this manner, the inventors of the present invention discovered a simple method of concentrating Cr within the cementite, and were able to manufacture a steel sheet that contradicts the conventional knowledge.

The reason for restricting the maximum heating temperature during annealing to a value within a range from 750 to 860° C. is that if the temperature is less than 750° C., then the carbides formed during hot rolling cannot be satisfactorily melted; thereby, the hard microstructure ratio required to achieve a high strength of 880 MPa cannot be ensured. Furthermore, unmelted carbides are unable to prevent the growth of recrystallized ferrite; therefore, the ferrite becomes coarser and elongated in the rolling direction, which causes a significant deterioration in the hole expandability and bendability. On the other hand, very high temperature annealing in which the maximum heating temperature reached exceeds 860° C. is not only undesirable from an economic viewpoint, but results in an austenite volume fraction during annealing that is too large, which means it becomes difficult to ensure that the volume fraction for the main phase ferrite is at least 50%, and results in a deterioration in ductility. For these reasons, the maximum temperature reached during annealing must be within a range from 750 to 860° C., and is preferably within a range from 780 to 840° C.

If the holding time during annealing is too short, then there is an increased chance of unmelted carbides remaining in the steel, which causes a reduction in the austenite volume fraction, and therefore a holding time of at least 10 seconds is preferred. On the other hand, if the holding time is too long, then there is an increased chance of the crystal grains coarsening, which causes a deterioration in the strength and the hole expandability, and therefore the upper limit for the holding time is preferably 1,000 seconds.

Subsequently, the annealed cold-rolled sheet must be cooled from the annealing temperature to 620° C. at a cooling rate of not more than 12° C./second. In the present invention, in order to avoid a strength reduction due to tempering of the martensite and a deterioration in spot weldability caused by an increase in C content required to overcome this strength reduction, the martensite transformation start temperature (Ms temperature) must be lowered as far as possible. Accordingly, in those cases where plating is not conducted after annealing, C is concentrated within the austenite to improve stability; therefore, the cooling of the annealed sheet from the annealing temperature to 620° C. must be conducted at a cooling rate of not more than 12° C./second. However, an extreme reduction in the cooling rate tends to cause an excessive increase in the ferrite volume fraction, so that even if the martensite is hardened, it becomes difficult to achieve a strength of at least 880 MPa. Furthermore, the austenite tends to transform into pearlite; therefore, the volume fraction of martensite required to ensure the desired level of strength cannot be achieved. For these reasons, the lower limit for the cooling rate must be at least 1° C./second. The cooling rate is preferably within a range from 1 to 10° C./second, and is more preferably within a range from 2 to 8° C./second.

The reason for specifying that the subsequent cooling from 620° C. to 570° C. is conducted at a cooling rate of at least 1° C./second is to suppress ferrite and pearlite transformation during the cooling process. Even when large amounts of Mn and Cr are added to suppress the growth of ferrite, and B is added to inhibit the generation of new ferrite nuclei, ferrite formation can still not be completely inhibited, and ferrite formation may still occur during the cooling process. Moreover, pearlite transformation also occurs at or in the vicinity of 600° C., which causes a dramatic reduction in the volume fraction of hard microstructures. As a result, the volume fraction of hard microstructures becomes too small; therefore, a maximum tensile strength of 880 MPa cannot be ensured. Moreover, the ferrite grain size also tends to increase; therefore, the hole expandability also deteriorates.

Accordingly, cooling must be conducted at a cooling rate of at least 1° C./second. On the other hand, if the cooling rate is increased significantly, then although no material problems arise, raising the cooling rate excessively tends to involve a significant increase in production cost, and consequently the upper limit for the cooling rate is preferably 200° C./second. The method used for conducting the cooling may be roll cooling, air cooling, water cooling, or a combination of any of these methods.

The steel sheet is then cooled through the temperature range from 250 to 100° C. at a cooling rate of at least 5° C./second. The reason for specifying a cooling rate of at least 5° C./second in the temperature range from 250 to 100° C. is to inhibit the tempering of martensite and the softening associated with such tempering. In those cases where the martensite transformation temperature is high, even if tempering by reheating or retention of the steel at the same temperature for a long period are not performed, iron-based carbides may still precipitate within the martensite, causing a decrease in the martensite hardness. The reason for specifying a temperature range of 250 to 100° C. is that above 250° C. or below 100° C., martensite transformation or precipitation of iron-based carbides within the martensite are unlikely to occur. Furthermore, if the cooling rate is less than 5° C., then the strength reduction caused by the tempering of martensite becomes significant, and therefore the cooling rate must be set to at least 5° C./second.

The annealed cold-rolled steel sheet may also be subjected to skin pass rolling. The reduction ratio for the skin pass rolling is preferably within a range from 0.1 to 1.5%. If the reduction ratio is less than 0.1%, then the effect is minimal and control is also difficult, and therefore 0.1% becomes the lower limit. If the reduction ratio exceeds 1.5%, then the productivity deteriorates dramatically, and therefore 1.5% acts as an upper limit. The skin pass rolling may be conducted either in-line or off-line. Furthermore, a single skin pass rolling may be performed to achieve the desired reduction ratio, or a plurality of rolling repetitions may be performed.

Furthermore, for the purpose of improving the chemical conversion properties of the annealed cold-rolled steel sheet, an acid wash treatment or alkali treatment may also be conducted. By conducting an alkali treatment or acid wash treatment, the chemical conversion properties of the steel sheet can be improved, and the coatability and corrosion resistance can also be improved.

When manufacturing a high-strength galvanized steel sheet of the present invention, the cold-rolled steel sheet is fed to a continuous hot-dip galvanizing processing line instead of the continuous annealing processing line described above.

In a similar manner to that described for the continuous annealing processing line, the cold-rolled sheet is first heated at a rate of temperature increase of not more than 7° C./second. The cold-rolled sheet is then held at a temperature of not less than 550° C. and not more than the Ac1 transformation point temperature for a period of 25 to 500 seconds. Annealing is then conducted at 750 to 860° C.

For the same reasons as those described for the continuous annealing processing line, the maximum heating temperature is preferably within a range from 750 to 860° C. The reason for restricting the maximum heating temperature to a value within a range from 750 to 860° C. is that if the temperature is less than 750° C., then the carbides formed during hot rolling cannot be satisfactorily melted; thereby, the hard microstructure ratio required to achieve a high strength of 880 MPa cannot be ensured. At a temperature of less than 750° C., ferrite and carbides (cementite) can coexist, and recrystallized ferrite can grow over cementite. As a result, if annealing is conducted at a temperature of less than 750° C., then the ferrite becomes coarse, and the hole expandability and bendability tend to deteriorate significantly. Furthermore, the volume fraction of hard microstructures also decreases; therefore, it is undesirable. On the other hand, very high temperature annealing in which the maximum heating temperature reached exceeds 860° C. is not only undesirable from an economic viewpoint, but results in an austenite volume fraction during annealing that is too large, which means it becomes difficult to ensure that the volume fraction for the main phase ferrite is at least 50%, and results in a deterioration in ductility. For these reasons, the maximum temperature reached during annealing must be within a range from 750 to 860° C., and is preferably within a range from 780 to 840° C.

For the same reasons as those described for the continuous annealing processing line, the annealing holding time when the cold-rolled sheet is fed to a continuous hot-dip galvanizing processing line is preferably at least 10 seconds. On the other hand, if the holding time is too long, then there is an increased chance of the crystal grains coarsening, causing a deterioration in the strength and the hole expandability. In order to prevent these types of problems occurring, the upper limit for the holding time is preferably 1,000 seconds.

Subsequently, the steel sheet must be cooled from the maximum heating temperature during annealing to 620° C. at a cooling rate of not more than 12° C./second. This is to promote ferrite formation during the cooling process and concentration of C within the austenite; thereby, lowering the Ms temperature to less than 300° C. In the case of an alloyed hot-dip galvanized steel sheet, because the sheet is first cooled and then subjected to a galvannealing treatment, the martensite is prone to tempering. Accordingly, the Ms temperature must be adequately lowered, so that martensite transformation prior to alloying can be suppressed. Generally, a high-strength steel sheet having a maximum tensile strength of at least 880 MPa and a reduced amount of added C contains large amounts of Mn and/or B; therefore, ferrite is unlikely to be formed during the cooling process, and the Ms temperature is high. As a result, martensite transformation tends to start prior to the galvannealing treatment and tempering tends to occur during the galvannealing treatment, which increases the likelihood of softening of the steel. In a conventional steel, if a large amount of ferrite is formed during the cooling process, then the strength decreases significantly; therefore, lowering the Ms temperature by increasing the volume fraction of ferrite has proven difficult. This effect is particularly marked if the cooling rate is reduced to not more than 12° C./second, and therefore the cooling rate must be set to not more than 12° C./second. However, an extreme reduction in the cooling rate tends to cause an excessive decrease in the volume fraction of the martensite; therefore, it becomes difficult to achieve a strength of at least 880 MPa. Furthermore, the austenite tends to transform into pearlite; therefore, the volume fraction of martensite required to ensure the desired level of strength cannot be achieved. For these reasons, the lower limit for the cooling rate must be at least 1° C./second.

Subsequently, in a similar manner to that described for the continuous annealing processing line, the annealed cold-rolled sheet is cooled from 620° C. to 570° C. at a cooling rate of at least 1° C./second. This suppresses ferrite and pearlite transformation during the cooling process.

Next, the annealed cold-rolled steel sheet is dipped in a galvanizing bath. The temperature of the steel sheet dipped in the plating bath (the dipped sheet temperature) is preferably within a temperature range from (the molten galvanizing bath temperature −40° C.) to (the molten galvanizing bath temperature +40° C.). Dipping in a galvanizing bath where the temperature of the annealed cold-rolled sheet does not fall not more than Ms ° C. is particularly desirable. This is to prevent softening caused by tempering of the martensite.

In addition, if the dipped sheet temperature is lower than (the molten galvanizing bath temperature −40° C.), then the heat loss upon dipping within the plating bath becomes large, and may cause partial solidification of the galvanizing; thereby, leading to a deterioration in the external appearance of the plating. For this reason, the lower limit for the dipped sheet temperature is set to (the molten galvanizing bath temperature −40° C.). However, if the sheet temperature prior to dipping is lower than (the molten galvanizing bath temperature −40° C.), then the sheet may be reheated prior to dipping to raise the sheet temperature to a value of not less than (the molten galvanizing bath temperature −40° C.). On the other hand, if the dipped sheet temperature exceeds (the molten galvanizing bath temperature +40° C.), then operational problems arise associated with the rise in the plating bath temperature. Besides pure zinc, the plating bath may also include other elements such as Fe, Al, Mg, Mn, Si, and Cr.

Subsequently, after dipping of the cold-rolled sheet in the galvanizing bath, the sheet is cooled through the temperature range from 250 to 100° C. at a cooling rate of at least 5° C./second, and then cooled to room temperature. This cooling can inhibit the tempering of martensite. Even when cooling is performed to a temperature not more than the Ms temperature, if the cooling rate is slow, then carbides may be precipitated within the martensite during the cooling. Accordingly, the cooling rate is set to at least 5° C./second. If the cooling rate is less than 5° C./second, then carbides are generated within the martensite during the cooling process, which softens the steel and makes it difficult to obtain a strength of at least 880 MPa.

When manufacturing an alloyed hot-dip galvanized steel sheet of the present invention, after dipping of the cold-rolled sheet in the galvanizing bath within the continuous hot-dip galvanizing processing line described above, a step of alloying the plating layer is further included. In this alloying step, the galvanized cold-rolled steel sheet is subjected to a galvannealing treatment at a temperature of at least 460° C. If this galvannealing treatment temperature is less than 460° C., then the alloying proceeds slowly, and the productivity is poor. Although there are no particular restrictions on the upper limit for the allotting temperature, if the temperature exceeds 620° C., then the alloying proceeds too fast, and favorable powdering cannot be achieved. Accordingly, the galvannealing treatment temperature is preferably not higher than 620° C. In the cold-rolled steel sheet of the present invention, from the viewpoint of structural control, because a mixture of Cr, Si, Mn, Ti, and B are added to the steel, the effect of retarding the transformation in the temperature range from 500 to 620° C. is extremely powerful. As a result, pearlite transformation and carbide precipitation need not be considered, the effects of the present invention can be achieved with good stability, and fluctuation in the mechanical properties is minimal. Furthermore, because the steel sheet of the present invention contains no martensite prior to the galvannealing treatment, softening of the steel due to tempering need not be considered.

After the heat treatment of the galvannealing treatment, skin pass rolling is preferably conducted for the purposes of controlling the level of surface roughness, controlling the sheet shape, and controlling the yield point elongation. The reduction ratio for this skin pass rolling is preferably within a range from 0.1 to 1.5%. If the reduction ratio for the skin pass rolling is less than 0.1%, then the effect is minimal, and control is also difficult, and therefore 0.1% becomes the lower limit. In contrast, if the reduction ratio for the skin pass rolling exceeds 1.5%, then the productivity deteriorates dramatically, and therefore 1.5% acts as an upper limit. The skin pass rolling may be conducted either in-line or off-line. Furthermore, a single skin pass rolling may be performed to achieve the desired reduction ratio, or a plurality of rolling repetitions may be performed.

Furthermore, in order to further enhance the plating adhesion, the steel sheet may be subjected to plating with one or more elements selected from amongst Ni, Cu, Co, and Fe prior to annealing, and conducting plating does not represent a departure from the present invention.

Moreover, with regard to the annealing conducted prior to plating, possible methods include the Sendzimir method (wherein after degreasing acid washing, the sheet is heating in a non-oxidizing atmosphere, annealed in a reducing atmosphere containing $H_2$ and $N_2$, cooled to a temperature close to the plating bath temperature, and then dipped in the plating bath), a complete reduction furnace method (wherein the steel sheet is cleaned prior to plating, by controlling the atmosphere during annealing so that the surface of the steel sheet is initially oxidized and is subsequently reduced, and then the cleaned sheet is dipped in the plating bath), and the flux method (wherein after degreasing acid washing, the sheet is subjected to a flux treatment using ammonium chloride or the like, and then dipped in the plating bath), and the effects of the present invention can be achieved regardless of the conditions under which treatment is conducted. Furthermore, regardless of the technique used for the annealing prior to plating, ensuring that the dew point during heating is −20° C. or higher is advantageous in terms of the wettability of the plating and the alloying reaction that occurs during alloying.

Subjecting the cold-rolled steel sheet of the present invention to electroplating causes absolutely no loss in the tensile strength, ductility, or hole expandability of the steel sheet. In other words, the cold-rolled steel sheet of the present invention is ideal as a material for electroplating. The effects of the present invention can also be obtained if the sheet is subjected to an organic coating or top-layer plating treatment.

The steel sheet of the present invention not only exhibits superior strength of welded joints, but also provides superior deformability (molding capabilities) for materials or components that include a welded portion. Generally, if the grain size of a steel microstructure is reduced to provide improved strength, then the heat that is applied during spot welding also causes heating of the regions at or in the vicinity of the melted portion, and this can cause coarsening of the grains and a marked deterioration in the strength within the heat affected regions. As a result, if the steel sheet containing the softened welded portion is subjected to press forming, then the deformation is concentrated within the softer region and may result in a fracture; therefore, the steel sheet exhibits poor molding capabilities. However, the steel sheet of the present invention includes elements such as Ti, Cr, Mn, and B, which exhibit powerful grain growth suppression effects are added in large quantities for the purpose of controlling the ferrite grain size during the annealing step, and as a result, coarsening of the ferrite grains within the heat affected regions does not occur; therefore, softening of the steel is unlikely to occur. In other words, the present invention not only provides superior strength for the joints formed by spot, laser, or arc welding, but also provides excellent press formability for components such as tailored blanks that include a welded portion (here, the term "formability" means that even if a material containing a welded portion is subjected to molding, fracture does not occur at the welded portion or within a heat affected region).

Furthermore, the high-strength, high-ductility galvanized steel sheet of the present invention that exhibits excellent formability and hole expandability is manufactured, in principle, by the typical steel production processes of ore refining, steel making, casting, hot rolling, and cold rolling, but even if production is conducted with some or all of these steps omitted, the effects of the present invention can still be obtained if the conditions according to the present invention are satisfied.

Examples

The effects of the present invention are described in further detail below using a series of examples. It should be noted that the present invention is not limited to the following examples, and various modifications may be made without departing from the scope of the present invention.

First, slabs containing the various components shown in Table 1 (units: % by mass) were heated to 1,230° C., and rough rolling was conducted at a reduction ratio of 87.5% to form a rough rolled sheet. Subsequently, using the conditions shown in Tables 2 to 5, each rough rolled sheet was held within a temperature range from 950 to 1,080° C., and was then subject to finish rolling at a reduction ratio of 90% to form a hot-rolled sheet. Subsequently, after conducting air cooling and water cooling, each hot-rolled sheet was coiled under the conditions shown in Tables 2 to 5. For a portion of the steel sheets, the steel sheet was subjected to water cooling and coiling immediately after finish rolling, without first performing air cooling. After acid washing, each of the obtained hot-rolled sheets was subjected to cold rolling to reduce the thickness of 3 mm of the hot-rolled sheet to 1.2 mm; thereby, obtaining a cold-rolled sheet.

In the tables, an underlines gentry represents a value outside of the range specified by the present invention. In Table 1, an entry of "–*1" means that the component was not added. In Tables 2 to 5, in the column labeled "Product sheet type *2", "CR" represents a cold-rolled steel sheet, "GI" represents a galvanized steel sheet, and "GA" represents an alloyed hot-dip galvanized steel sheet. Further, "FT" represents the finish rolling temperature (or finishing temperature).

TABLE 1

| Steel No. | C | Cr | Si | Mn | B | Ti | P | S | Al | N | O | Other | Ac1 | |
|---|---|---|---|---|---|---|---|---|---|---|---|---|---|---|
| A | 0.065 | 1.46 | 0.42 | 1.86 | 0.0014 | 0.067 | 0.009 | 0.0019 | 0.017 | 0.0024 | 0.0019 | — | 740 | Inventive example |
| B | 0.075 | 0.95 | 0.59 | 2.07 | 0.0022 | 0.059 | 0.008 | 0.0021 | 0.019 | 0.0023 | 0.0017 | — | 734 | Inventive example |
| C | 0.086 | 0.45 | 0.62 | 2.38 | 0.0028 | 0.054 | 0.008 | 0.0022 | 0.014 | 0.0021 | 0.0019 | — | 723 | Inventive example |
| D | 0.095 | 0.24 | 0.49 | 2.24 | 0.0024 | 0.054 | 0.011 | 0.0021 | 0.036 | 0.0022 | 0.0024 | — | 717 | Inventive example |
| E | 0.077 | 0.19 | 0.33 | 2.17 | 0.0017 | 0.019 | 0.008 | 0.0024 | 0.019 | 0.0024 | 0.0019 | Ni = 0.04 | 713 | Inventive example |
| F | 0.08 | 0.88 | 0.78 | 2.02 | 0.0008 | 0.044 | 0.009 | 0.0029 | 0.033 | 0.0045 | 0.0026 | Cu = 0.03 | 739 | Inventive example |
| G | 0.086 | 0.84 | 0.47 | 2.16 | 0.0021 | 0.026 | 0.010 | 0.0023 | 0.042 | 0.0019 | 0.0023 | V = 0.071 | 728 | Inventive example |
| H | 0.081 | 0.64 | 0.88 | 2.41 | 0.0006 | 0.046 | 0.009 | 0.0019 | 0.019 | 0.0022 | 0.0020 | Nb =0.032 | 734 | Comparative example |
| I | 0.079 | 0.71 | 1.42 | 1.98 | 0.0029 | 0.041 | 0.009 | 0.0021 | 0.016 | 0.0021 | 0.0019 | Mo =0.34 | 755 | Comparative example |
| J | 0.16 | —*1 | 0.54 | 2.42 | —*1 | —*1 | 0.011 | 0.0021 | 0.028 | 0.0025 | 0.0024 | — | 713 | Comparative example |
| K | 0.027 | 0.57 | 0.59 | 2.07 | 0.0039 | 0.020 | 0.009 | 0.0025 | 0.016 | 0.0022 | 0.0026 | — | 728 | Comparative example |
| L | 0.095 | 0.67 | 0.61 | 2.20 | —*1 | 0.019 | 0.011 | 0.0021 | 0.015 | 0.0022 | 0.0016 | — | 729 | Comparative example |
| M | 0.077 | —*1 | 0.62 | 2.23 | 0.0012 | 0.062 | 0.009 | 0.0028 | 0.030 | 0.0027 | 0.0026 | — | 699 | Comparative example |
| N | 0.092 | 0.49 | —*1 | 1.84 | 0.0021 | 0.018 | 0.013 | 0.0024 | 0.025 | 0.0027 | 0.0028 | — | 703 | Comparative example |
| O | 0.089 | —*1 | —*1 | 1.39 | —*1 | 0.044 | 0.022 | 0.0025 | 0.039 | 0.0023 | 0.0025 | — | 708 | Comparative example |
| P | 0.155 | 0.32 | 0.51 | 2.43 | 0.0015 | 0.057 | 0.009 | 0.0021 | 0.024 | 0.0032 | 0.002 | — | 717 | Comparative example |
| Q | 0.088 | 0.62 | 0.72 | 2.16 | 0.0014 | 0.054 | 0.011 | 0.0032 | 0.028 | 0.0086 | 0.0032 | — | 731 | Comparative example |
| R | 0.074 | 0.72 | 0.92 | 2.77 | 0.0005 | 0.06 | 0.007 | 0.0033 | 0.019 | 0.0025 | 0.0017 | — | 732 | Comparative example |

TABLE 2

| Steel No. | Product sheet type *2 | Holding time at 950 to 1,080° C. (seconds) | FT (° C.) | Coiling temperature of hot-rolled sheet (° C.) |
|---|---|---|---|---|
| A-1 | CR | 5 | 910 | 540 |
| A-2 | CR | 1 | 960 | 530 |
| A-3 | CR | 20 | 880 | 560 |
| A-4 | CR | 6 | 780 | 510 |
| A-5 | CR | 11 | 890 | 490 |
| A-6 | CR | 6 | 920 | 540 |
| A-7 | CR | 10 | 870 | 490 |
| A-8 | CR | 11 | 900 | 540 |
| A-9 | CR | 8 | 920 | 560 |
| A-10 | CR | 12 | 810 | 720 |
| A-11 | CR | 8 | 890 | 610 |
| A-12 | CR | 9 | 900 | 540 |
| A-13 | CR | 10 | 880 | 620 |
| A-14 | CR | 12 | 930 | 540 |
| A-15 | CR | 10 | 910 | 570 |
| A-16 | CR | 9 | 890 | 580 |
| A-17 | CR | 16 | 920 | 570 |
| A-18 | CR | 14 | 910 | 600 |
| A-19 | GI | 10 | 910 | 540 |
| A-20 | GI | 2 | 960 | 510 |

TABLE 3

| Steel No. | Product sheet type *2 | Holding time at 950 to 1,080° C. (seconds) | FT (° C.) | Coiling temperature of hot-rolled sheet (° C.) |
|---|---|---|---|---|
| A-21 | GI | 10 | 890 | 540 |
| A-22 | GI | 12 | 920 | 570 |
| A-23 | GI | 10 | 910 | 560 |
| A-24 | GA | 12 | 870 | 560 |
| A-25 | GA | 1 | 950 | 550 |
| A-26 | GA | 6 | 1020 | 570 |
| A-27 | GA | 12 | 910 | 460 |
| A-28 | GA | 9 | 910 | 520 |
| A-29 | GA | 34 | 790 | 420 |
| A-30 | GA | 10 | 900 | 490 |
| A-31 | GA | 12 | 910 | 550 |
| A-32 | GA | 8 | 890 | 530 |
| A-33 | GA | 12 | 940 | 570 |
| A-34 | GA | 12 | 920 | 600 |
| A-35 | GA | 14 | 900 | 560 |
| A-36 | GA | 8 | 920 | 550 |
| B-1 | CR | 10 | 890 | 510 |
| B-2 | GI | 11 | 920 | 560 |
| B-3 | GA | 7 | 900 | 540 |
| C-1 | CR | 10 | 900 | 530 |

TABLE 4

| Steel No. | Product sheet type *2 | Holding time at 950 to 1,080° C. (seconds) | FT (° C.) | Coiling temperature of hot-rolled sheet (° C.) |
|---|---|---|---|---|
| C-2 | CR | 8 | 890 | 610 |
| D-1 | CR | 12 | 890 | 490 |
| E-1 | CR | 10 | 920 | 530 |
| E-2 | CR | 2 | 790 | 460 |
| E-3 | CR | 1 | 1020 | 620 |
| E-4 | CR | 6 | 940 | 580 |
| E-5 | CR | 12 | 920 | 560 |
| E-6 | CR | 11 | 900 | 530 |
| E-7 | GI | 8 | 890 | 540 |
| E-8 | GA | 11 | 910 | 560 |
| E-9 | GA | 2 | 920 | 540 |
| E-10 | GA | 180 | 780 | 510 |
| E-11 | GA | 10 | 880 | 530 |
| E-12 | GA | 8 | 900 | 730 |
| E-13 | GA | 6 | 920 | 550 |
| E-14 | CR | 12 | 900 | 560 |
| E-15 | CR | 10 | 910 | 580 |
| E-16 | CR | 11 | 920 | 570 |
| F-1 | CR | 12 | 890 | 560 |
| F-2 | GA | 8 | 910 | 530 |

TABLE 5

| Steel No. | Product sheet type *2 | Holding time at 950 to 1,080° C. (seconds) | FT (° C.) | Coiling temperature of hot-rolled sheet (° C.) |
|---|---|---|---|---|
| G-1 | CR | 8 | 920 | 520 |
| G-2 | CR | 10 | 940 | 600 |
| H-1 | CR | 8 | 910 | 550 |
| H-2 | GI | 8 | 920 | 540 |
| H-3 | GA | 9 | 910 | 480 |
| I-1 | CR | 11 | 880 | 550 |
| I-2 | GA | 8 | 910 | 530 |
| J-1 | CR | 10 | 890 | 610 |
| J-2 | CR | 10 | 890 | 590 |
| K-1 | CR | 13 | 920 | 540 |
| L-1 | GA | 8 | 910 | 540 |
| M-1 | GA | 8 | 890 | 570 |
| N-1 | GA | 9 | 880 | 610 |
| O-1 | GA | 10 | 880 | 620 |
| P-1 | CR | 12 | 920 | 570 |
| P-2 | GA | 10 | 910 | 530 |
| Q-1 | GA | 11 | 910 | 560 |
| R-1 | GA | 12 | 890 | 550 |

(Cold-Rolled Sheet)

Each cold-rolled sheet was subjected to annealing using an annealing apparatus under the conditions shown in Tables 6 to 9.

The cold-rolled sheet was heated at a predetermined average heating rate (average rate of temperature increase), and was then held for a predetermined holding time at a temperature of not less than 550° C. and not more than the Ac1 transformation point temperature. The sheet was then heated to a specified annealing temperature, and held at that temperature for 90 seconds. Subsequently, each sheet was cooled under the cooling conditions shown in Tables 6 to 9. The sheet was then cooled to room temperature at a predetermined cooling rate specified in Tables 10 to 13, thereby completing production of a cold-rolled steel sheet.

In Tables 10 to 13, an entry "–*3" means that the step was not performed, "*6" means that after first cooling to room temperature, a tempering treatment was conducted at the specified temperature.

TABLE 6

| Steel No. | Rate of temperature increase (° C./second) | Holding time at 550° C. to Ac1 (seconds) | Annealing temperature (° C.) | Average cooling rate from annealing temperature to 620° C. (° C./second) | Average cooling rate from 620° C. to 570° C. (° C./second) |
|---|---|---|---|---|---|
| A-1 | 3.8 | 55 | 820 | 4.0 | 40 |
| A-2 | 3.7 | 68 | 780 | 4.0 | 40 |
| A-3 | 5.4 | 38 | 820 | 6.0 | 60 |
| A-4 | 3.9 | 51 | 800 | 4.0 | 40 |
| A-5 | 2.2 | 94 | 790 | 2.0 | 20 |
| A-6 | 6.4 | 34 | 780 | 12.0 | 120 |
| A-7 | 3.8 | 58 | 820 | 4.0 | 40 |
| A-8 | 3.8 | 58 | 820 | 4.0 | 40 |
| A-9 | 5.8 | 42 | 820 | 9.0 | 90 |
| A-10 | 3.8 | 52 | 810 | 4.0 | 40 |
| A-11 | 3.4 | 61 | 720 | 4.0 | 40 |
| A-12 | 3.9 | 54 | 840 | 4.0 | 40 |
| A-13 | 4.0 | 50 | 890 | 4.0 | 40 |
| A-14 | 3.8 | 54 | 820 | 4.0 | 40 |
| A-15 | 8.2 | 27 | 820 | 4.0 | 40 |

TABLE 6-continued

| Steel No. | Rate of temperature increase (° C./second) | Holding time at 550° C. to Ac1 (seconds) | Annealing temperature (° C.) | Average cooling rate from annealing temperature to 620° C. (° C./second) | Average cooling rate from 620° C. to 570° C. (° C./second) |
|---|---|---|---|---|---|
| A-16 | 3.4 | 10 | 830 | 4.6 | 40 |
| A-17 | 3.8 | 58 | 820 | 36.0 | 40 |
| A-18 | 3.8 | 54 | 820 | 4 | 40 |
| A-19 | 3.9 | 56 | 810 | 7.0 | 6.8 |
| A-20 | 2.2 | 92 | 770 | 2.6 | 2.4 |

TABLE 7

| Steel No. | Rate of temperature increase (° C./second) | Holding time at 550° C. to Ac1 (seconds) | Annealing temperature (° C.) | Average cooling rate from annealing temperature to 620° C. (° C./second) | Average cooling rate from 620° C. to 570° C. (° C./second) |
|---|---|---|---|---|---|
| A-21 | 3.8 | 52 | 810 | 7.1 | 6.8 |
| A-22 | 0.6 | 18 | 830 | 7.2 | 7.1 |
| A-23 | 3.8 | 56 | 820 | 3.8 | 40 |
| A-24 | 2.2 | 88 | 830 | 2.7 | 2.4 |
| A-25 | 2.2 | 88 | 810 | 2.6 | 2.4 |
| A-26 | 2.1 | 94 | 790 | 2.7 | 2.4 |
| A-27 | 2.1 | 94 | 790 | 2.6 | 2.4 |
| A-28 | 0.8 | 175 | 820 | 2.2 | 0.4 |
| A-29 | 2.2 | 92 | 830 | 2.8 | 2.4 |
| A-30 | 1.7 | 118 | 690 | 2.6 | 2.4 |
| A-31 | 2.4 | 85 | 900 | 2.7 | 2.4 |
| A-32 | 2.2 | 92 | 820 | 2.6 | 2.4 |
| A-33 | 2.2 | 92 | 830 | 2.6 | 2.4 |
| A-34 | 8.6 | 32 | 820 | 2.6 | 2.4 |
| A-35 | 0.6 | 92 | 850 | 2.6 | 2.4 |
| A-36 | 2.4 | 90 | 820 | 2.6 | 2.4 |
| B-1 | 5.4 | 43 | 820 | 6.0 | 60 |
| B-2 | 2.2 | 92 | 820 | 2.5 | 2.4 |
| B-3 | 2.2 | 92 | 830 | 2.7 | 2.4 |
| C-1 | 4.9 | 48 | 830 | 5.0 | 50 |

TABLE 8

| Steel No. | Rate of temperature increase (° C./second) | Holding time at 550° C. to Ac1 (seconds) | Annealing temperature (° C.) | Average cooling rate from annealing temperature to 620° C. (° C./second) | Average cooling rate from 620° C. to 570° C. (° C./second) |
|---|---|---|---|---|---|
| C-2 | 6.0 | 38 | 870 | 7.0 | 70 |
| D-1 | 5.4 | 36 | 810 | 6.0 | 60 |
| E-1 | 3.8 | 60 | 810 | 4.0 | 40 |
| E-2 | 3.6 | 62 | 780 | 4.0 | 40 |
| E-3 | 6.6 | 40 | 790 | 12.0 | 120 |
| E-4 | 5.5 | 39 | 820 | 9.0 | 90 |
| E-5 | 10.2 | 51 | 830 | 4.2 | 40 |
| E-6 | 3.8 | 16 | 820 | 4.0 | 40 |
| E-7 | 2.2 | 95 | 820 | 2.6 | 2.4 |
| E-8 | 6.4 | 38 | 840 | 8.2 | 6.8 |
| E-9 | 2.8 | 74 | 800 | 4.9 | 4.6 |
| E-10 | 2.8 | 76 | 800 | 5.0 | 4.6 |
| E-11 | 2.2 | 94 | 780 | 2.8 | 2.4 |
| E-12 | 2.8 | 74 | 820 | 5.0 | 4.6 |
| E-13 | 1.8 | 120 | 720 | 2.8 | 2.4 |
| E-14 | 10.6 | 42 | 820 | 4.2 | 40 |
| E-15 | 28.2 | 45 | 830 | 4.2 | 40 |
| E-16 | 3.8 | 18 | 820 | 3.9 | 40 |
| F-1 | 3.8 | 62 | 820 | 3.8 | 40 |
| F-2 | 4.8 | 64 | 830 | 2.8 | 2.4 |

TABLE 9

| Steel No. | Rate of temperature increase (° C./second) | Holding time at 550° C. to Ac1 (seconds) | Annealing temperature (° C.) | Average cooling rate from annealing temperature to 620° C. (° C./second) | Average cooling rate from 620° C. to 570° C. (° C./second) |
|---|---|---|---|---|---|
| G-1 | 5.4 | 36 | 820 | 6.0 | 60 |
| G-2 | 4.1 | 56 | 870 | 4.0 | 40 |
| H-1 | 3.8 | 58 | 830 | 4.0 | 40 |

TABLE 9-continued

| Steel No. | Rate of temperature increase (° C./second) | Holding time at 550° C. to Ac1 (seconds) | Annealing temperature (° C.) | Average cooling rate from annealing temperature to 620° C. (° C./second) | Average cooling rate from 620° C. to 570° C. (° C./second) |
|---|---|---|---|---|---|
| H-2 | 2.8 | 73 | 820 | 4.9 | 4.6 |
| H-3 | 2.2 | 92 | 830 | 2.6 | 2.4 |
| I-1 | 5.4 | 44 | 820 | 6.0 | 60 |
| I-2 | 4.2 | 54 | 820 | 4.9 | 4.6 |
| J-1 | 3.7 | 58 | 800 | 4.0 | 40 |
| J-2 | 5.6 | 39 | 860 | 6.0 | 60 |
| K-1 | 3.9 | 60 | 830 | 4.0 | 40 |
| L-1 | 2.9 | 72 | 840 | 5.2 | 4.6 |
| M-1 | 2.6 | 82 | 780 | 5.1 | 4.6 |
| N-1 | 2.2 | 92 | 820 | 2.7 | 2.4 |
| O-1 | 2.8 | 82 | 820 | 5.2 | 4.6 |
| P-1 | 5.6 | 44 | 820 | 6.0 | 60 |
| P-2 | 2.8 | 76 | 840 | 5.2 | 4.6 |
| Q-1 | 2.6 | 84 | 800 | 5.0 | 4.6 |
| R-1 | 2.1 | 94 | 780 | 2.7 | 2.4 |

TABLE 10

| Steel No. | Alloying temperature (° C.) | Tempering temperature (° C.) | Average cooling rate from 250° C. to 100° C. (° C./second) | |
|---|---|---|---|---|
| A-1 | —*3 | —*3 | 8 | Inventive example |
| A-2 | —*3 | —*3 | 8 | Comparative example |
| A-3 | —*3 | —*3 | 12 | Inventive example |
| A-4 | —*3 | —*3 | 8 | Comparative example |
| A-5 | —*3 | —*3 | 5 | Comparative example |
| A-6 | —*3 | —*3 | 16 | Inventive example |
| A-7 | —*3 | —*3 | 8 | Inventive example |
| A-8 | —*3 | —*3 | 9 | Inventive example |
| A-9 | —*3 | —*3 | 19 | Inventive example |
| A-10 | —*3 | —*3 | 9 | Comparative example |
| A-11 | —*3 | —*3 | 9 | Comparative example |
| A-12 | —*3 | —*3 | 8 | Inventive example |
| A-13 | —*3 | —*3 | 8 | Comparative example |
| A-14 | —*3 | 460*6 | 9 | Comparative example |
| A-15 | —*3 | —*3 | 8 | Comparative example |
| A-16 | —*3 | —*3 | 9 | Comparative example |
| A-17 | —*3 | —*3 | 12 | Comparative example |
| A-18 | —*3 | —*3 | 1 | Comparative example |
| A-19 | —*3 | —*3 | 15 | Inventive example |
| A-20 | —*3 | —*3 | 8 | Comparative example |

TABLE 11

| Steel No. | Alloying temperature (° C.) | Tempering temperature (° C.) | Average cooling rate from 250° C. to 100° C. (° C./second) | |
|---|---|---|---|---|
| A-21 | —*3 | 370*6 | 14 | Comparative example |
| A-22 | —*3 | —*3 | 9 | Comparative example |
| A-23 | —*3 | —*3 | 1 | Comparative example |
| A-24 | 510 | —*3 | 8 | Inventive example |
| A-25 | 520 | —*3 | 8 | Comparative example |
| A-26 | 540 | —*3 | 8 | Comparative example |
| A-27 | 550 | —*3 | 8 | Comparative example |
| A-28 | 530 | —*3 | 8 | Comparative example |
| A-29 | 520 | —*3 | 8 | Comparative example |
| A-30 | 540 | —*3 | 8 | Comparative example |
| A-31 | 530 | —*3 | 8 | Comparative example |
| A-32 | 540 | —*3 | 8 | Inventive example |
| A-33 | 530 | 430*6 | 8 | Comparative example |
| A-34 | 540 | —*3 | 9 | Comparative example |
| A-35 | 530 | —*3 | 10 | Comparative example |
| A-36 | 530 | —*3 | 1 | Comparative example |
| B-1 | —*3 | —*3 | 12 | Inventive example |
| B-2 | —*3 | —*3 | 8 | Inventive example |
| B-3 | 510 | —*3 | 9 | Inventive example |
| C-1 | —*3 | —*3 | 11 | Inventive example |

TABLE 12

| Steel No. | Alloying temperature (° C.) | Tempering temperature (° C.) | Average cooling rate from 250° C. to 100° C. (° C./second) | |
|---|---|---|---|---|
| C-2 | —*3 | —*3 | 15 | Comparative example |
| D-1 | —*3 | —*3 | 14 | Inventive example |
| E-1 | —*3 | —*3 | 9 | Inventive example |
| E-2 | —*3 | —*3 | 10 | Comparative example |
| E-3 | —*3 | —*3 | 26 | Comparative example |
| E-4 | —*3 | —*3 | 21 | Inventive example |
| E-5 | —*3 | —*3 | 8 | Comparative example |
| E-6 | —*3 | —*3 | 10 | Comparative example |
| E-7 | —*3 | —*3 | 7 | Inventive example |
| E-8 | 520 | —*3 | 19 | Inventive example |
| E-9 | 540 | —*3 | 14 | Comparative example |
| E-10 | 480 | —*3 | 14 | Comparative example |
| E-11 | 520 | —*3 | 8 | Comparative example |
| E-12 | 540 | —*3 | 13 | Comparative example |
| E-13 | 530 | —*3 | 9 | Comparative example |
| E-14 | —*3 | —*3 | 10 | Comparative example |
| E-15 | —*3 | —*3 | 12 | Comparative example |
| E-16 | —*3 | —*3 | 9 | Comparative example |
| F-1 | —*3 | —*3 | 10 | Inventive example |
| F-2 | —*3 | —*3 | 9 | Inventive example |

TABLE 13

| Steel No. | Alloying temperature (° C.) | Tempering temperature (° C.) | Average cooling rate from 250° C. to 100° C. (° C./second) | |
|---|---|---|---|---|
| G-1 | —*3 | —*3 | 14 | Inventive example |
| G-2 | 590 | —*3 | 9 | Comparative example |
| H-1 | —*3 | —*3 | 9 | Comparative example |
| H-2 | —*3 | —*3 | 12 | Comparative example |
| H-3 | 520 | —*3 | 8 | Comparative example |
| I-1 | —*3 | —*3 | 12 | Comparative example |
| I-2 | 520 | —*3 | 11 | Comparative example |
| J-1 | —*3 | —*3 | 8 | Comparative example |
| J-2 | —*3 | —*3 | 13 | Comparative example |
| K-1 | —*3 | —*3 | 9 | Comparative example |
| L-1 | 540 | —*3 | 8 | Comparative example |
| M-1 | 540 | —*3 | 9 | Comparative example |
| N-1 | 570 | —*3 | 6 | Comparative example |
| O-1 | 540 | —*3 | 8 | Comparative example |
| P-1 | —*3 | 420*6 | 14 | Comparative example |
| P-2 | 550 | 420*6 | 8 | Comparative example |
| Q-1 | 530 | —*3 | 7 | Comparative example |
| R-1 | 540 | —*3 | 6 | Comparative example |

With regard to the atmosphere inside the furnace used for manufacturing the cold-rolled steel sheet, a device was attached that combusted a complex mixed vapor of CO and $H_2$ and introduced the resulting $H_2O$ and $CO_2$, and $N_2$ gas was also introduced that contained 10% by volume of $H_2$ having a dew point of −40° C.; thereby, the atmosphere inside the furnace was able to be controlled.

(Galvanized Steel Sheet, Alloyed Hot-Dip Galvanized Steel Sheet)

A cold-rolled sheet was subjected to annealing and plating using a continuous hot-dip galvanizing apparatus.

With regard to the annealing conditions and the atmosphere inside the furnace, in order to ensure favorable plating properties, a device was attached that combusted a complex mixed vapor of CO and $H_2$ and introduced the resulting $H_2O$ and $CO_2$, and $N_2$ gas was also introduced that contained 10% by volume of $H_2$ having a dew point of −10° C., with the annealing being conducted under the conditions shown in Tables 6 to 9.

The cold-rolled sheet that had been annealed and then cooled at a specified cooling rate was then dipped in a galvanizing bath. Subsequently, the sheet was cooled using the cooling rates shown in Tables 10 to 13, thus completing preparation of a series of galvanized steel sheets.

When manufacturing an alloyed hot-dip galvanized steel sheet, the cold-rolled sheet was dipped in the galvanizing bath, and then was subjected to a galvannealing treatment at a temperature shown in Tables 10 to 13 within a range from 480 to 590° C.

Particularly in the case of Steels Nos. A to J, which contain a large amount of Si, if the atmosphere inside the furnace is not controlled, then the steel is prone to plating faults or a delay in the alloying. Accordingly, when a steel having a high Si content is subjected to galvanizing and galvannealing treatment, the atmosphere (the oxygen potential) must be controlled.

The amount of galvanizing on the plated steel sheet was set to approximately 50 g/m$^2$ for each of both surfaces. Finally, the resulting steel sheet was subjected to skin pass rolling at a reduction ratio of 0.3%.

Next, the microstructure of each of the obtained cold-rolled steel sheets, hot-dip galvanized steel sheets, and alloyed hot-dip galvanized steel sheets was analyzed using the method described below. A cross-section along the rolling direction of the steel sheet or a cross-section in a direction orthogonal to the rolling direction was etched using either a nital reagent or a reagent disclosed in Japanese Unexamined Patent Application, First Publication No. S59-219473, and the surface was then inspected at 1,000-fold magnification under an optical microscope, and at 1,000 to 100,000-fold magnification using both scanning and transmission electron microscopes. These observations enabled each of the phases within the microstructure, namely the ferrite, pearlite, cementite, martensite, bainite, austenite, and residual microstructures to be identified, the locations and shape of each phase were observed, and the ferrite grain size was measured.

The volume fraction of each phase was determined by observing the surface at 2,000-fold magnification using a scanning electron microscope, measuring 20 fields of view, and then determining the various volume fractions using the point count method.

In order to measure the martensite block size, the microstructure was observed using an FE-SEM EBSP method, the crystal orientations were determined, and the block sizes were measured. In the steel sheet of the present invention, because the martensite block size was considerably smaller than that of conventional steels, care needed to be taken to ensure that an adequately small step size was used during the FE-SEM EBSP analysis. In the present invention, scanning was conducted at a step size of 50 nm, the microstructure of each martensite grain microstructure was analyzed, and the block size was determined.

Furthermore, the Cr content within the martensite/the Cr content within the polygonal ferrite was measured using EPMA. Because the steel sheets of the present invention have a very fine microstructure, analysis was performed at 3,000-fold magnification, using a spot diameter of 0.1 μm.

In this research, measurement of the hardness ratio of martensite relative to ferrite (DHTM/DHTF) was conducted by using a penetration depth measuring method to measure the respective hardness values, using a dynamic microhardness meter having a Berkovich type triangular pyramidal indenter and using a loading of 0.2 g.

Steel sheets of which the hardness ratio of DHTM/DHTF was at least 3.0 were deemed to satisfy the range of the present invention. This ratio represents the martensite hardness required for ensuring that the steel sheet exhibits favorable strength, hole expandability, and weldability simultaneously, and is a result that was determined by analyzing the results from various tests. If this hardness ratio is less than 3.0, then various problems may arise, including an inability to achieve the desired strength, or a deterioration in the hole expandability or the weldability, and as a result, this hardness ratio must be at least 3.0.

Furthermore, tensile tests were conducted to measure the yield stress (YS), the maximum tensile stress (TS), and the total elongation (El). The steel sheets of the present invention are composite microstructures including ferrite and hard microstructures, and in many cases, a yield point elongation may not exist. For this reason, the yield stress was measured using a 0.2% offset method. Then, steel sheets of which the value of TS×El is at least 16,000 (MPa×%) were deemed to be high-strength steel sheets having a favorable balance of strength and ductility.

The hole expansion ratio (λ) was evaluated by punching a circular hole having a diameter of 10 mm through the steel sheet with a clearance of 12.5%, and then using a 60° conical punch to expand the hole with the burr set on the die side.

Under each set of conditions, five separate hole expansion tests were performed, and the average value of the five tests was recorded as the hole expansion ratio. Steel sheets of which the value of TS×λ was at least 40,000 (MPa×%) were deemed to be high-strength steel sheets having a favorable balance of strength and hole expandability.

Steel sheets which satisfy both the aforementioned favorable balance of strength and ductility and the favorable balance of strength and hole expandability are deemed to be high-strength steel sheets having excellent balance between hole expandability and ductility.

The bendability of the steel sheets was also evaluated. The bendability was evaluated by preparing a test piece having a dimension of 100 mm in a direction perpendicular to the rolling direction and a dimension of 30 mm in the rolling direction, and then evaluating the minimum bending radius at which a 90° bend causes cracking. In other words, the bendability was evaluated using a series of punches having a bending radius at the punch tip of 0.5 mm to 3.0 mm in steps of 0.5 mm, and the minimum bending radius was defined as the smallest bending radius at which cracking of the steel sheet did not occur. When the bendability of the steel sheets of the present invention was evaluated, a very favorable bendability of 0.5 mm was achieved for those steels that satisfied the conditions of the present invention.

The spot weldability was evaluated under the conditions listed below.

Electrode (dome type): tip diameter 6 mmϕ

Applied force: 4.3 kN

Welding current: (CE-0.5) kA (CE: the current immediately prior to spatter occurrence)

Welding time: 14 cycles

Holding time: 10 cycles

After welding, a tensile shear strength test and a cross tension strength test were conducted in accordance with ES Z 3136 and JIS Z 3137 respectively. For each test, five welds were performed using a welding current of CE, and the average values were recorded as the tensile shear test tensile shear strength (TSS) and the cross tension test tensile strength (CTS) respectively. Steel sheets of which the ductility ratio represented by the ratio of these two values (namely, CTS/TSS) was at least 0.4 were deemed to be high-strength steel sheets of excellent weldability.

The results obtained are shown in Tables 14 to 25.

In Tables 14 to 17, in the column labeled "Product sheet type *2", "CR" represents a cold-rolled steel sheet, "GI" represents a galvanized steel sheet, and "GA" represents an alloyed hot-dip galvanized steel sheet. Further, in the column labeled "Microstructure *4", "F' represents ferrite, "B" represents bainite, "M" represents martensite, "TM" represents tempered martensite, "RA represents residual austenite, "P" represents pearlite, and "C" represents cementite.

Furthermore, in Tables 18 to 21, in the column labeled "Ferrite configuration *5", "polygonal" refers to ferrite grains having an aspect ratio of not more than 2, whereas "elongated" refers to ferrite grains that are elongated in the rolling direction.

TABLE 14

| Steel No. | Product sheet type *2 | Microstructure *4 Main phase | Hard micro-structures | Residual micro-structures | Ferrite volume fraction (%) | Martensite volume fraction (%) | Bainite volume fraction (%) |
|---|---|---|---|---|---|---|---|
| A-1 | CR | F | B, M | RA | 68 | 27 | 3 |
| A-2 | CR | F | B, M | RA | 78 | 17 | 3 |
| A-3 | CR | F | B, M | RA | 67 | 27 | 4 |
| A-4 | CR | F | B, M | RA | 69 | 25 | 5 |
| A-5 | CR | F | B, M | RA | 76 | 21 | 2 |
| A-6 | CR | F | B, M | RA | 75 | 21 | 3 |
| A-7 | CR | F | B, M | RA | 69 | 27 | 3 |
| A-8 | CR | F | B, M | — | 71 | 24 | 4 |
| A-9 | CR | F | B, M | RA | 66 | 28 | 4 |
| A-10 | CR | F | B, M | RA | 70 | 25 | 5 |
| A-11 | CR | F | — | C | 100 | — | — |
| A-12 | CR | F | B, M | RA | 62 | 34 | 3 |
| A-13 | CR | — | M | — | 0 | 100 | — |
| A-14 | CR | F | B, TM | — | 70 | 27 | 3 |
| A-15 | CR | F | B, M | RA | 77 | 20 | 2 |
| A-16 | CR | F | B, M | RA | 74 | 22 | 3 |
| A-17 | CR | F | B, M | RA | 44 | 32 | 23 |
| A-18 | CR | F | B, TM | RA | 70 | 24 | 4 |
| A-19 | GI | F | B, M | RA | 68 | 28 | 3 |
| A-20 | GI | F | B, M | RA | 80 | 15 | 3 |

TABLE 15

| Steel No. | Product sheet type *2 | Microstructure *4 Main phase | Hard micro-structures | Residual micro-structures | Ferrite volume fraction (%) | Martensite volume fraction (%) | Bainite volume fraction (%) |
|---|---|---|---|---|---|---|---|
| A-21 | GI | F | B, TM | — | 69 | 29 | 2 |
| A-22 | GI | F | B, M | RA | 78 | 20 | 1 |
| A-23 | GI | F | B, TM | — | 69 | 31 | — |
| A-24 | GA | F | B, M | RA | 71 | 25 | 3 |
| A-25 | GA | F | B, M | RA | 74 | 23 | 2 |
| A-26 | GA | F | B, M | RA | 74 | 22 | 3 |
| A-27 | GA | F | B, M | RA | 80 | 17 | 2 |
| A-28 | GA | F | — | P | 78 | — | — |
| A-29 | GA | F | B, M | RA | 68 | 31 | — |
| A-30 | GA | F | — | C | 100 | — | — |
| A-31 | GA | — | M | — | 0 | 100 | — |
| A-32 | GA | F | B, M | RA | 69 | 27 | 3 |
| A-33 | GA | F | B, TM | — | 72 | 26 | 2 |
| A-34 | GA | F | B, M | RA | 73 | 25 | 1 |
| A-35 | GA | F | B, M | RA | 75 | 22 | 2 |
| A-36 | GA | F | B, TM | RA | 72 | 28 | — |
| B-1 | CR | F | B, M | RA | 70 | 26 | 3 |
| B-2 | GI | F | B, M | RA | 74 | 22 | 2 |
| B-3 | GA | F | B, M | RA | 73 | 23 | 3 |
| C-1 | CR | F | B, M | — | 66 | 32 | 2 |

TABLE 16

| Steel No. | Product sheet type *2 | Microstructure *4 Main phase | Hard micro-structures | Residual micro-structures | Ferrite volume fraction (%) | Martensite volume fraction (%) | Bainite volume fraction (%) |
|---|---|---|---|---|---|---|---|
| C-2 | CR | F | B, M | — | 24 | 48 | 28 |
| D-1 | CR | F | B, M | RA | 69 | 28 | 2 |
| E-1 | CR | F | B, M | RA | 71 | 24 | 4 |
| E-2 | CR | F | B, M | RA | 79 | 17 | 3 |
| E-3 | CR | F | B, M | RA | 76 | 21 | 2 |
| E-4 | CR | F | B, M | RA | 71 | 25 | 3 |
| E-5 | CR | F | B, M | RA | 73 | 23 | 2 |
| E-6 | CR | F | B, M | RA | 74 | 20 | 3 |
| E-7 | GI | F | B, M | RA | 73 | 23 | 3 |
| E-8 | GA | F | B, M | — | 67 | 31 | 2 |
| E-9 | GA | F | B, M | RA | 78 | 20 | 1 |

TABLE 16-continued

| Steel No. | Product sheet type *2 | Microstructure *4 Main phase | Hard micro-structures | Residual micro-structures | Ferrite volume fraction (%) | Martensite volume fraction (%) | Bainite volume fraction (%) |
|---|---|---|---|---|---|---|---|
| E-10 | GA | F | B, M | RA | 79 | 18 | 2 |
| E-11 | GA | F | B, M | RA | 80 | 15 | 3 |
| E-12 | GA | F | B, M | RA | 74 | 22 | 3 |
| E-13 | GA | F | — | C | 100 | — | — |
| E-14 | GA | F | B, M | RA | 75 | 21 | 2 |
| E-15 | GA | F | B, M | RA | 73 | 24 | 1 |
| E-16 | GA | F | B, M | RA | 76 | 20 | 3 |
| F-1 | CR | F | B, M | RA | 72 | 24 | 2 |
| F-2 | GA | F | B, M | RA | 72 | 26 | 1 |

TABLE 17

| Steel No. | Product sheet type *2 | Microstructure *4 Main phase | Hard micro-structures | Residual micro-structures | Ferrite volume fraction (%) | Martensite volume fraction (%) | Bainite volume fraction (%) |
|---|---|---|---|---|---|---|---|
| G-1 | CR | F | B, M | RA | 73 | 24 | 2 |
| G-2 | GA | F | B, M | — | 40 | 37 | 23 |
| H-1 | CR | F | B, M | RA | 67 | 29 | 3 |
| H-2 | GI | F | B, M | RA | 73 | 23 | 3 |
| H-3 | GA | F | B, M | — | 72 | 26 | 2 |
| I-1 | CR | F | B, M | RA | 68 | 26 | 4 |
| I-2 | GA | F | B, M | RA | 66 | 31 | 2 |
| J-1 | CR | F | B, M | RA | 82 | 16 | 1 |
| J-2 | CR | F | B, M | — | 26 | 53 | 21 |
| K-1 | CR | F | B, M | RA | 86 | 12 | 1 |
| L-1 | GA | F | B, M | RA | 84 | 11 | 4 |
| M-1 | GA | F | B, M | RA | 78 | 18 | 3 |
| N-1 | GA | F | — | P | 83 | — | — |
| O-1 | GA | F | — | P | 93 | — | — |
| P-1 | CR | F | B, TM | — | 63 | 34 | 3 |
| P-2 | GA | F | B, TM | — | 68 | 30 | 2 |
| Q-1 | GA | F | B, M | RA | 72 | 23 | 3 |
| R-1 | GA | F | B, M | RA | 75 | 21 | 3 |

TABLE 18

| Steel No. | Ferrite configuration *5 | Ferrite grain size (μm) | Martensite block size (μm) | Cr concentration ratio (Cr concentration within martensite/Cr concentration within ferrite) | Hardness ratio (DHTM/DHTF) |
|---|---|---|---|---|---|
| A-1 | Polygonal | 2.6 | 0.6 | 1.44 | 3.29 |
| A-2 | Elongated | 3.4 | 0.4 | 1.06 | 3.64 |
| A-3 | Polygonal | 2.4 | 0.5 | 1.42 | 3.24 |
| A-4 | Elongated | 3.2 | 0.5 | 1.14 | 3.29 |
| A-5 | Elongated | 3.1 | 0.4 | 1.18 | 3.56 |
| A-6 | Polygonal | 2.5 | 0.4 | 1.38 | 3.59 |
| A-7 | Polygonal | 2.4 | 0.6 | 1.44 | 3.26 |
| A-8 | Polygonal | 2.5 | 0.6 | 1.42 | 3.07 |
| A-9 | Polygonal | 2.3 | 0.6 | 1.39 | 3.24 |
| A-10 | Polygonal | 4.3 | 0.9 | 1.17 | 3.37 |
| A-11 | Polygonal | 4.4 | — | — | — |
| A-12 | Elongated | 1.8 | 0.7 | 1.47 | 3.05 |
| A-13 | Polygonal | — | 2.0 | — | — |
| A-14 | Polygonal | 3.2 | 0.6 | 1.44 | 2.42 |
| A-15 | Polygonal | 2.8 | 1.4 | 1.08 | 2.86 |
| A-16 | Polygonal | 2.4 | 1.2 | 1.04 | 2.74 |
| A-17 | Polygonal | 2.1 | 1.1 | 1.32 | 2.81 |
| A-18 | Polygonal | 2.5 | 0.6 | 1.38 | 2.91 |
| A-19 | Polygonal | 2.2 | 0.6 | 1.42 | 3.26 |
| A-20 | Elongated | 3.4 | 0.4 | 1.02 | 3.92 |

TABLE 19

| Steel No. | Ferrite configuration *5 | Ferrite grain size (μm) | Martensite block size (μm) | Cr concentration ratio (Cr concentration within martensite/Cr concentration within ferrite) | Hardness ratio (DHTM/DHTF) |
|---|---|---|---|---|---|
| A-21 | Polygonal | 2.4 | 0.6 | 1.41 | 2.72 |
| A-22 | Elongated | 2.3 | 1.1 | 1.07 | 2.60 |
| A-23 | Polygonal | 2.5 | 0.6 | 1.39 | 2.88 |
| A-24 | Polygonal | 2.3 | 0.5 | 1.03 | 3.39 |
| A-25 | Elongated | 2.4 | 0.5 | 1.44 | 3.51 |
| A-26 | Polygonal | 4.4 | 0.4 | 1.19 | 3.48 |
| A-27 | Elongated | 3.3 | 0.4 | 1.29 | 3.76 |
| A-28 | Polygonal | 2.5 | — | — | — |
| A-29 | Elongated | 1.9 | 0.7 | 1.44 | 3.25 |
| A-30 | Polygonal | 4.3 | — | — | — |
| A-31 | Polygonal | — | 2.1 | — | — |
| A-32 | Polygonal | 2.2 | 0.6 | 1.44 | 3.29 |
| A-33 | Polygonal | 2.6 | 0.4 | 1.42 | 2.24 |
| A-34 | Polygonal | 2.4 | 1.1 | 1.08 | 2.87 |
| A-35 | Polygonal | 2.5 | 1.3 | 1.05 | 2.69 |
| A-36 | Polygonal | 2.4 | 0.4 | 1.34 | 2.71 |
| B-1 | Polygonal | 2.4 | 0.5 | 1.46 | 3.44 |
| B-2 | Polygonal | 2.6 | 0.5 | 1.32 | 3.66 |
| B-3 | Polygonal | 2.5 | 0.4 | 1.29 | 3.52 |
| C-1 | Polygonal | 2.6 | 0.5 | 1.34 | 3.47 |

TABLE 20

| Steel No. | Ferrite configuration *5 | Ferrite grain size (μm) | Martensite block size (μm) | Cr concentration ratio (Cr concentration within martensite/Cr concentration within ferrite) | Hardness ratio (DHTM/DHTF) |
|---|---|---|---|---|---|
| C-2 | Polygonal | 1.9 | 1.4 | 1.08 | 2.67 |
| D-1 | Polygonal | 2.4 | 0.6 | 1.29 | 3.67 |
| E-1 | Polygonal | 2.3 | 0.4 | 1.29 | 3.43 |
| E-2 | Elongated | 3.6 | 0.4 | 1.04 | 3.87 |
| E-3 | Elongated | 2.2 | 0.5 | 1.06 | 3.69 |
| E-4 | Polygonal | 2.3 | 0.5 | 1.34 | 3.49 |
| E-5 | Polygonal | 3 | 1.3 | 1.05 | 2.86 |
| E-6 | Polygonal | 3.2 | 1.4 | 1.04 | 2.72 |
| E-7 | Polygonal | 2.4 | 0.4 | 1.29 | 3.56 |
| E-8 | Polygonal | 2.2 | 0.4 | 1.35 | 3.22 |
| E-9 | Elongated | 2.3 | 0.4 | 1.07 | 3.79 |
| E-10 | Elongated | 3.5 | 0.5 | 1.02 | 3.89 |
| E-11 | Elongated | 3.4 | 0.5 | 1.32 | 4.11 |
| E-12 | Elongated | 3.2 | 0.4 | 1.37 | 3.56 |
| E-13 | Polygonal | 4.6 | 0.5 | — | — |
| E-14 | Polygonal | 2.8 | 1.2 | 1.06 | 2.82 |
| E-15 | Polygonal | 3.2 | 1.3 | 1.08 | 2.70 |
| E-16 | Polygonal | 3.1 | 1.2 | 1.06 | 2.64 |
| F-1 | Polygonal | 2.6 | 0.4 | 1.39 | 3.23 |
| F-2 | Polygonal | 2.8 | 0.5 | 1.44 | 3.45 |

TABLE 21

| Steel No. | Ferrite configuration *5 | Ferrite grain size (μm) | Martensite block size (μm) | Cr concentration ratio (Cr concentration within martensite/Cr concentration within ferrite) | Hardness ratio (DHTM/DHTF) |
|---|---|---|---|---|---|
| G-1 | Polygonal | 2.3 | 0.5 | 1.28 | 3.55 |
| G-2 | Polygonal | 2.8 | 1.5 | 1.06 | 2.86 |
| H-1 | Elongated | 2.2 | 0.4 | 1.29 | 3.46 |
| H-2 | Elongated | 2.3 | 0.5 | 1.32 | 3.76 |
| H-3 | Elongated | 2.3 | 0.4 | 1.29 | 3.62 |
| I-1 | Elongated | 2.1 | 0.5 | 1.41 | 3.76 |
| I-2 | Elongated | 2.3 | 0.5 | 1.42 | 3.98 |
| J-1 | Polygonal | 4.8 | 0.8 | — | 4.01 |
| J-2 | Polygonal | 2.3 | 1.4 | — | 2.81 |
| K-1 | Polygonal | 3.6 | 0.4 | 1.33 | 3.14 |
| L-1 | Polygonal | 4.2 | 0.4 | 1.34 | 3.82 |
| M-1 | Polygonal | 4.6 | 1.3 | — | 2.79 |
| N-1 | Polygonal | 3.3 | 0.5 | — | — |
| O-1 | Polygonal | 5.8 | — | — | — |

TABLE 21-continued

| Steel No. | Ferrite configuration *5 | Ferrite grain size (μm) | Martensite block size (μm) | Cr concentration ratio (Cr concentration within martensite/Cr concentration within ferrite) | Hardness ratio (DHTM/DHTF) |
|---|---|---|---|---|---|
| P-1 | Polygonal | 2.8 | 0.4 | 1.40 | 2.45 |
| P-2 | Polygonal | 3.2 | 0.3 | 1.37 | 2.36 |
| Q-1 | Polygonal | 3 | 0.5 | 1.28 | 3.42 |
| R-l | Elongated | 2.8 | 0.5 | 1.07 | 3.54 |

TABLE 22

| Steel No. | Tensile properties YS (MPa) | TS (MPa) | El (%) | λ (%) | TS · El (MPa · %) | TS · λ (MPa · %) | Ductility ratio | |
|---|---|---|---|---|---|---|---|---|
| A-1 | 648 | 1021 | 18.6 | 78 | 18991 | 79638 | 0.55 | Inventive example |
| A-2 | 599 | 987 | 18.8 | 23 | 18556 | 22701 | 0.51 | Comparative example |
| A-3 | 655 | 1054 | 17.8 | 67 | 18761 | 70618 | 0.52 | Inventive example |
| A-4 | 633 | 1014 | 17.2 | 27 | 17441 | 27378 | 0.5 | Comparative example |
| A-5 | 614 | 1006 | 18.3 | 34 | 18410 | 34204 | 0.51 | Comparative example |
| A-6 | 603 | 1072 | 18.6 | 53 | 19939 | 56816 | 0.52 | Inventive example |
| A-7 | 652 | 1026 | 18.7 | 82 | 19186 | 84132 | 0.53 | Inventive example |
| A-8 | 689 | 956 | 20.7 | 89 | 19789 | 85084 | 0.57 | Inventive example |
| A-9 | 668 | 1012 | 18.4 | 86 | 18621 | 87032 | 0.58 | Inventive example |
| A-10 | 467 | 871 | 18.6 | 27 | 16201 | 23517 | 0.52 | Comparative example |
| A-11 | 534 | 864 | 17.9 | 21 | 15466 | 18144 | 0.51 | Comparative example |
| A-12 | 712 | 1065 | 17 | 93 | 18105 | 99045 | 0.55 | Inventive example |
| A-13 | 899 | 981 | 8.9 | 103 | 8731 | 101043 | 0.57 | Comparative example |
| A-14 | 633 | 823 | 19.1 | 77 | 15719 | 63371 | 0.59 | Comparative example |
| A-15 | 586 | 856 | 17.6 | 33 | 15066 | 28248 | 0.56 | Comparative example |
| A-16 | 567 | 837 | 18.9 | 29 | 15819 | 24273 | 0.52 | Comparative example |
| A-17 | 599 | 876 | 19.6 | 34 | 17170 | 29784 | 0.55 | Comparative example |
| A-18 | 703 | 873 | 14.6 | 50 | 12746 | 43650 | 0.56 | Comparative example |
| A-19 | 675 | 1073 | 17.5 | 79 | 18778 | 84767 | 0.57 | Inventive example |
| A-20 | 586 | 956 | 18.2 | 29 | 17399 | 27724 | 0.54 | Comparative example |

TABLE 23

| Steel No. | Tensile properties YS (MPa) | TS (MPa) | El (%) | λ (%) | TS · El (MPa · %) | TS · λ (MPa · %) | Ductility ratio | |
|---|---|---|---|---|---|---|---|---|
| A-21 | 613 | 856 | 18.9 | 59 | 16178 | 50504 | 0.56 | Comparative example |
| A-22 | 631 | 869 | 16.7 | 27 | 14512 | 23463 | 0.57 | Comparative example |
| A-23 | 686 | 864 | 16.1 | 56 | 13910 | 48384 | 0.55 | Comparative example |
| A-24 | 659 | 1047 | 18.4 | 66 | 19265 | 69102 | 0.58 | Inventive example |
| A-25 | 635 | 1035 | 17.9 | 27 | 18527 | 27945 | 0.51 | Comparative example |
| A-26 | 564 | 953 | 17.6 | 30 | 16773 | 28590 | 0.53 | Comparative example |
| A-27 | 579 | 1027 | 17.9 | 35 | 18383 | 35945 | 0.53 | Comparative example |
| A-28 | 554 | 872 | 18.2 | 27 | 15870 | 23544 | 0.52 | Comparative example |
| A-29 | 701 | 1042 | 16.4 | 21 | 17089 | 21882 | 0.59 | Comparative example |
| A-30 | 507 | 854 | 17.6 | 34 | 15030 | 29036 | 0.54 | Comparative example |
| A-31 | 904 | 998 | 8.5 | 96 | 8483 | 95808 | 0.55 | Comparative example |
| A-32 | 637 | 1053 | 18.2 | 62 | 19165 | 65286 | 0.54 | Inventive example |
| A-33 | 552 | 821 | 19.4 | 68 | 15927 | 55828 | 0.57 | Comparative example |
| A-34 | 602 | 876 | 18.9 | 42 | 16556 | 36792 | 0.58 | Comparative example |
| A-35 | 599 | 865 | 19.2 | 36 | 16608 | 31140 | 0.56 | Comparative example |
| A-36 | 675 | 864 | 16.4 | 56 | 14170 | 48384 | 0.58 | Comparative example |
| B-1 | 669 | 1034 | 18.2 | 82 | 18819 | 84788 | 0.55 | Inventive example |
| B-2 | 634 | 1048 | 18.6 | 72 | 19493 | 75456 | 0.54 | Inventive example |
| B-3 | 629 | 1057 | 18.5 | 69 | 19555 | 72933 | 0.53 | Inventive example |
| C-1 | 654 | 1034 | 18.7 | 76 | 19336 | 78584 | 0.51 | Inventive example |

TABLE 24

| Steel No. | Tensile properties YS (MPa) | TS (MPa) | El (%) | λ (%) | TS · El (MPa · %) | TS · λ (MPa · %) | Ductility ratio | |
|---|---|---|---|---|---|---|---|---|
| C-2 | 692 | 863 | 11 | 35 | 9493 | 30205 | 0.52 | Comparative example |
| D-1 | 602 | 1013 | 16.9 | 76 | 17120 | 76988 | 0.46 | Inventive example |
| E-1 | 675 | 1057 | 17.6 | 68 | 18603 | 71876 | 0.55 | Inventive example |
| E-2 | 627 | 998 | 18.4 | 13 | 18363 | 12974 | 0.56 | Comparative example |
| E-3 | 646 | 1009 | 16.8 | 24 | 16951 | 24216 | 0.54 | Comparative example |
| E-4 | 690 | 1084 | 17.1 | 53 | 18536 | 57452 | 0.55 | Inventive example |
| E-5 | 605 | 852 | 19.4 | 27 | 16529 | 23004 | 0.56 | Comparative example |
| E-6 | 567 | 860 | 18.6 | 33 | 15996 | 28380 | 0.57 | Comparative example |
| E-7 | 669 | 1032 | 18 | 66 | 18576 | 68112 | 0.52 | Inventive example |
| E-8 | 732 | 1076 | 16.4 | 79 | 17646 | 85004 | 0.57 | Inventive example |
| E-9 | 673 | 1048 | 17.6 | 24 | 18445 | 25152 | 0.56 | Comparative example |
| E-10 | 543 | 864 | 18.9 | 19 | 16330 | 16416 | 0.58 | Comparative example |
| E-11 | 586 | 968 | 18.6 | 33 | 18005 | 31944 | 0.54 | Comparative example |
| E-12 | 472 | 847 | 17 | 34 | 14399 | 28798 | 0.55 | Comparative example |
| E-13 | 459 | 831 | 19.5 | 29 | 16205 | 24099 | 0.53 | Comparative example |
| E-14 | 592 | 846 | 19.7 | 33 | 16666 | 27918 | 0.54 | Comparative example |
| E-15 | 581 | 821 | 18.6 | 21 | 15271 | 17241 | 0.56 | Comparative example |
| E-16 | 602 | 861 | 18.4 | 29 | 15842 | 24969 | 0.57 | Comparative example |
| F-1 | 669 | 1029 | 18.1 | 56 | 18625 | 57624 | 0.54 | Inventive example |
| F-2 | 654 | 1033 | 17.4 | 66 | 17974 | 68178 | 0.51 | Inventive example |

TABLE 25

| Steel No. | Tensile properties YS (MPa) | TS (MPa) | El (%) | λ (%) | TS · El (MPa · %) | TS · λ (MPa · %) | Ductility ratio | |
|---|---|---|---|---|---|---|---|---|
| G-1 | 702 | 1057 | 16.9 | 72 | 17863 | 76104 | 0.5 | Inventive example |
| G-2 | 649 | 870 | 13.2 | 39 | 11484 | 33930 | 0.52 | Comparative example |
| H-1 | 723 | 1045 | 11.6 | 16 | 12122 | 16720 | 0.47 | Comparative example |
| H-2 | 752 | 1075 | 12.3 | 10 | 13223 | 10750 | 0.51 | Comparative example |
| H-3 | 726 | 1064 | 11.2 | 22 | 11917 | 23408 | 0.53 | Comparative example |
| I-1 | 751 | 1094 | 9.8 | 13 | 10721 | 14222 | 0.51 | Comparative example |
| I-2 | 746 | 1086 | 12.1 | 18 | 13141 | 19548 | 0.54 | Comparative example |
| J-1 | 561 | 1017 | 18.9 | 17 | 19221 | 17289 | 0.37 | Comparative example |
| J-2 | 701 | 842 | 11.3 | 24 | 9515 | 20208 | 0.34 | Comparative example |
| K-1 | 527 | 768 | 22.6 | 56 | 17357 | 43008 | 0.64 | Comparative example |
| L-1 | 443 | 824 | 23.4 | 24 | 19282 | 19776 | 0.53 | Comparative example |
| M-1 | 569 | 864 | 18.6 | 27 | 16070 | 23328 | 0.55 | Comparative example |
| N-1 | 545 | 806 | 19.6 | 29 | 15798 | 23374 | 0.52 | Comparative example |
| O-1 | 337 | 451 | 34.6 | 97 | 15605 | 43747 | 0.51 | Comparative example |
| P-1 | 762 | 1003 | 17.2 | 56 | 17252 | 56168 | 0.36 | Comparative example |
| P-2 | 782 | 998 | 16.8 | 62 | 16766 | 61876 | 0.34 | Comparative example |
| Q-1 | 642 | 1021 | 16.2 | 19 | 16540 | 19399 | 0.5 | Comparative example |
| R-1 | 782 | 1056 | 13.2 | 24 | 13939 | 25344 | 0.48 | Comparative example |

In the steel sheet of the present invention, by making the block size of the martensite that acts as the hard microstructure extremely small at not more than 0.9 μm, and reducing the grain size of the main phase ferrite, a strength increase is achieved due to fine grain strengthening; therefore, enabling excellent welded joint strength to be obtained even when the amount of added C is suppressed to 0.095% or less. In addition, because the steel sheet of the present invention contains added Cr and Ti, softening under the heat applied during welding is hard to occur; therefore, fractures in the areas surrounding the welded portion can also be suppressed. As a result, effects are achieved which exceed those expected by simply reducing the amount of added C to not more than 0.095%, and the steel sheet exhibits particularly superior weldability.

The steel sheet of the present invention exhibits both excellent hole expandability and elongation, and therefore excels in stretch flange formability, which is a form of molding that requires simultaneous hole expandability and elongation, and stretch formability, which correlates with the n value (uniform elongation).

As is evident from Tables 14 to 25, those steels labeled as Steel No. A-1, 3, 6 to 9, 12, 19, 24, and 32, Steel No. B-1 to 3, Steel No. C-1, Steel No. D-1, Steel No. E-1, 4, 7, and 8, Steel No. F-1 and 2, and Steel No. G-1 each has a chemical composition that satisfies the prescribed ranges of the present invention, and their production conditions satisfy the ranges prescribed in the present invention. As a result, the main phase can be formed as polygonal ferrite having a grain size of not more than 4 μm and a volume fraction that exceeds 50%. Furthermore, each steel also includes hard microstructures of bainite and martensite, the martensite block size is not more than 0.9 μm, and the Cr content within the martensite can be controlled to 1.1 to 1.5 times the Cr content within the polygonal ferrite. As a result, a steel sheet that has a maximum tensile strength of at least 880 MPa and exhibits an extremely favorable balance of weldability, ductility, and hole expandability can be manufactured.

On the other hand, in the case of Steel No. A-2, 20, and 25, Steel No. E-2, 3, and 9, the holding time at 950 to 1,080° C. is short, and as a result, fine precipitates of TiC and NbC cannot be precipitated in the austenite range, and the austenite grain size after finish rolling cannot be reduced. Furthermore, the austenite often adopts a flattened shape after finish rolling, and this affects the form of the ferrite after cold rolling and annealing, which tends to be prone to becoming elongated in the rolling direction.

As a result, the value of TS×λ, which is an indicator of the hole expandability, is a comparatively low value of less than 40,000 (MPa×%), indicating inferior hole expandability.

In the case of Steel No. A-4 and 29, and Steel No. E-2 and 10, because the finish rolling temperature (FT) is less than 820° C., after finish rolling, a non-recrystallized austenite that is significantly elongated in the rolling direction is obtained, and even if this sheet is coiled, cold rolled and annealed, the effects of this elongated non-recrystallized austenite remain.

As a result, because the main phase ferrite becomes an elongated ferrite that is stretched in the rolling direction, the value of TS×λ is a comparatively low value of less than 40,000 (MPa×%), indicating inferior hole expandability.

In the case of Steel No. A-26 and Steel No. E-3, the finish rolling temperature exceeds 950° C. and is extremely high, which causes an increase in the austenite grain size after finish rolling, results in non-uniform microstructures after cold rolling and annealing, and causes the formation of elongated ferrite after cold rolling and annealing. Furthermore, this temperature range represents the range at which TiC precipitation occurs most readily, which causes an excessive precipitation of TiC and prevents the Ti from being utilized in the reduction of the ferrite grain size or precipitation strengthening in later steps, resulting in a reduction in the steel strength. As a result, the value of TS×λ is a comparatively low value of less than 40,000 (MPa×%), indicating inferior hole expandability.

For Steel No. A-10 and Steel No. E-12, the coiling temperature is a very high temperature that exceeds 630° C., and because the hot-rolled sheet microstructures become ferrite and pearlite, the microstructures obtained after cold rolling and annealing are also affected by these hot-rolled sheet microstructures. Specifically, even when the hot-rolled sheet containing coarse microstructures composed of ferrite and pearlite is subjected to cold rolling, the pearlite microstructures cannot be dispersed finely in a uniform manner; therefore, the ferrite microstructures that are elongated by the cold rolling process remain in an elongated form even after recrystallization, and the austenite (and after cooling, the martensite) microstructures formed due to transformation of the pearlite microstructures tend to form linked band-like microstructures. As a result, in processing such as hole expansion molding that may result in crack formation, cracking tends to develop along the elongated ferrite or band-like aligned martensite microstructures; therefore, hole expandability becomes inferior. Furthermore, because the coiling temperature is too high, the precipitated TiC and NbC become coarser and do not contribute to precipitation strengthening, which results in a decrease in strength. Moreover, because no solid-solubilized Ti or Nb remain in the steel, the delay of the ferrite recrystallization during annealing tends to be inadequate; therefore, the ferrite grain size tends to exceed 4 μm, which makes it more difficult to achieve the hole expandability improvement provided by the reduced grain size, and results in a value of TS×λ that is a comparatively low value of less than 40,000 (MPa×%), indicating inferior hole expandability.

For Steel No. A-15 and 34, and Steel No. E-14 and 15, because the rate of temperature increase during annealing is a high value exceeding 7° C./second, the Cr concentration within the martensite cannot be increased to the prescribed range, making it impossible to achieve the desired strength of at least 880 MPa.

For Steel No. A-16 and 22, and Steel No. E-6 and 16, the holding time at a temperature within the range from 550° C. to Ac1 is a short time of less than 25 seconds, and therefore the effect of promoting cementite based on $Cr_{23}C_6$ nuclei, and the effect of concentrating Cr within the cementite cannot be achieved; therefore, the strengthening effect dependent on these effects, namely the strengthening effect caused by the reduction in the martensite block size, is unattainable. For this reason, a strength of at least 880 MPa cannot be achieved.

For Steel No. A-11 and 30, and Steel No. E-13, the annealing temperature after cold rolling is a low value of less than 750° C., and therefore the cementite does not transform into austenite. As a result, the pinning effect provided by austenite does not manifest; therefore, the grain size of the recrystallized ferrite tends to exceed 4 μm, which makes it more difficult to achieve the hole expandability improvement provided by the reduced ferrite grain size that represents an effect of the present invention, and results in inferior hole expandability.

For Steel No. A-13 and 31, and Steel No. C-2, because the annealing temperature exceeds 860° C. and is therefore too high, a ferrite volume fraction of at least 50% cannot be achieved, and the value of TS×El is a low value of less than 16,000 (MPa×%), indicating inferior ductility.

For Steel No. A-18, 23 and 36, because the cooling rate in the temperature range from 250 to 100° C. is less than 5° C./second, iron-based carbides are precipitated within the martensite during the cooling process (this includes tempered martensite that has undergone tempering). As a result, the hard microstructures are softened, making it impossible to ensure a strength of at least 880 MPa.

Although Steel No. J-1 provides a high strength of at least 880 MPa and excellent ductility, because the C content exceeds 0.095%, the ductility ratio falls to less than 0.5, indicating inferior weldability. Furthermore, because the steel contains no Cr, Ti, or B, the effect of improving the hole expandability provided by the reduced ferrite grain size is unobtainable, resulting in inferior hole expandability.

Steel No. K-1 includes a mixture of Cr, Ti, and B, and therefore exhibits favorable weldability, ductility, and hole expandability, but because the C content is a very low value of less than 0.05%, an adequate fraction of hard microstructures cannot be ensured; therefore, a strength of at least 880 MPa cannot be achieved.

Steel No. L-1 contains no B, and therefore it is difficult to achieve the reduction in ferrite grain size provided by structural control of the hot-rolled sheet, or the reduction in grain size resulting from suppression of transformation during annealing, and as a result, the hole expandability is poor. Because it is difficult to suppress ferrite transformation during the cooling conducted during annealing, an excessive amount of ferrite is formed, making it impossible to achieve a strength of at least 880 MPa.

Steel No. M-1 contains no Cr, and therefore it is difficult to achieve the reduction in the martensite block size. As a result, the martensite block size exceeds 0.9 μm, and it becomes impossible to achieve a strength of at least 880 MPa. The steel also exhibits poor hole expandability.

Steel No. N-1 contains no Si, and therefore pearlite tends to form readily in the cooling process conducted after annealing, or cementite and pearlite tend to form readily during the galvannealing treatment, and as a result, the fraction of hard microstructures decreases dramatically, making it impossible to achieve a strength of at least 880 MPa.

Steel No. O-1 contains no Cr, Si or B, and also has a Mn content of less than 1.7%, and as a result, neither a reduction in the ferrite grain size nor a satisfactory fraction of hard microstructures can be ensured, making it impossible to achieve a strength of at least 880 MPa.

Steel No. Q-1 has a N content of at least 0.005%, and therefore the value of TS×λ is low and the hole expandability is poor.

Steel No. R-1 has a Mn content that exceeds 2.6%, and therefore the ratio of Cr within martensite/Cr within polygonal ferrite is small, confirming that concentration of the Cr within the martensite has not occurred. As a result, the value of TS×λ is low and the hole expandability is poor.

For Steel No. A-14, 21 and 33, and Steel No. P-1 and 2, because martensite is formed first, and then heating is conducted, the hard microstructures include tempered martensite. As a result, the strength decreases compared with an equivalent steel containing the same fractions of ferrite and martensite, making it difficult to achieve a strength of 880 MPa, or if the strength is retained by increasing the volume fraction of tempered martensite, then the weldability deteriorates.

INDUSTRIAL APPLICABILITY

The present invention provides a low-cost steel sheet which has a maximum tensile strength of at least 880 MPa, making it ideal for automobile, structural components, reinforcing components and underbody components, and which also exhibits excellent formability with favorable levels of weldability, ductility, and hole expandability. Because this steel sheet is ideal for automobile structural components, reinforcing components, and underbody components, it can be expected to contribute to a considerable lightening of automobile weights; therefore, the industrial effects of the invention are extremely valuable.

The invention claimed is:

1. A cold-rolled steel sheet, comprising, in terms of mass %:

C: not less than 0.05% and not more than 0.095%;

Cr: not less than 0.15% and not more than 2.0%;

B: not less than 0.0003% and not more than 0.01%;

Si: not less than 0.3% and not more than 2.0%;

Mn: not less than 1.7% and not more than 2.6%;

Ti: not less than 0.005% and not more than 0.14%;

P: not more than 0.03%;

S: not more than 0.01%;

Al: not more than 0.1%;

N: less than 0.005%;

O: not less than 0.0005% and not more than 0.005%; and containing as the remainder, iron and unavoidable impurities, wherein a microstructure of said steel sheet comprises mainly polygonal ferrite having a crystal grain size of not more than 4 μm, and hard microstructures of bainite and martensite, a volume fraction of said polygonal ferrite is in a range of 50% to 90%, a volume fraction of said hard microstructure is in a range of less than 50%, and a volume fraction of said bainite is in a range of less than 20%, a block size of said martensite is not more than 0.9 μm, a Cr content within said martensite is 1.1 to 1.5 times a Cr content within said polygonal ferrite, and a tensile strength is at least 880 MPa.

2. The cold-rolled steel sheet according to claim 1, wherein said steel sheet comprises no Nb.

3. The cold-rolled steel sheet according to claim 1, wherein said steel sheet further comprises, in terms of mass %, one or more elements selected from the group consisting of:

Ni: less than 0.05%;

Cu: less than 0.05%; and

W: less than 0.05%.

4. The cold-rolled steel sheet according to claim 1, wherein said steel sheet further comprises, in terms of mass %, V: not less than 0.01% and not more than 0.14%.

5. A galvanized steel sheet, comprising: a cold-rolled steel sheet according to claim 1; and a galvanized plating formed on a surface of said cold-rolled steel sheet.

6. An alloyed hot-dip galvanized steel sheet, comprising: a cold-rolled steel sheet according to claim 1; and an alloyed hot-dip galvanized plating formed on a surface of said cold-rolled steel sheet.

* * * * *